US008154188B2

(12) United States Patent
Suwa et al.

(10) Patent No.: US 8,154,188 B2
(45) Date of Patent: Apr. 10, 2012

(54) ELECTRON EMITTING DEVICE AND IMAGE DISPLAYING APPARATUS USING THE SAME

(75) Inventors: Takanori Suwa, Kawasaki (JP); Toshihiko Takeda, Yokohama (JP); Tamayo Hiroki, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 12/694,474

(22) Filed: Jan. 27, 2010

(65) Prior Publication Data

US 2010/0201247 A1 Aug. 12, 2010

(30) Foreign Application Priority Data

Feb. 12, 2009 (JP) ..... 2009-029312
Feb. 13, 2009 (JP) ..... 2009-030586

(51) Int. Cl.
*H01J 1/304* (2006.01)
*H01J 19/02* (2006.01)
*H01J 19/38* (2006.01)

(52) U.S. Cl. ..... 313/497; 313/495; 313/309

(58) Field of Classification Search ..... 313/495–497, 313/309

See application file for complete search history.

(56) References Cited

U.S. PATENT DOCUMENTS

| | | | | |
|---|---|---|---|---|
| 5,859,493 | A * | 1/1999 | Kim | 313/309 |
| 7,884,533 | B2 * | 2/2011 | Tsukamoto et al. | 313/309 |
| 2001/0019247 | A1 | 9/2001 | Tsukamoto | |
| 2009/0256457 | A1 | 10/2009 | Tsukamoto et al. | |
| 2009/0273270 | A1 * | 11/2009 | Suzuki | 313/409 |

FOREIGN PATENT DOCUMENTS

| | | | |
|---|---|---|---|
| CN | 101556892 | A | 10/2009 |
| CN | 101572206 | A | 11/2009 |
| EP | 0665571 | A1 | 8/1995 |
| EP | 2109131 | A2 | 10/2009 |
| JP | 2000-251643 | A | 9/2000 |
| JP | 2001-167693 | A | 6/2001 |
| JP | 2001-229809 | A | 8/2001 |

OTHER PUBLICATIONS

State Intellectual Property Office of the People's Republic of China, Office Action dated Aug. 17, 2011, in connection with China Patent Application No. 201010115887.0, 8 pages (and English translation thereof).

European Search Report issued by the European Patent Office in the European Application No. 10152999.8 dated Jun. 24, 2011—9 pages.

* cited by examiner

*Primary Examiner* — Karabi Guharay

(74) *Attorney, Agent, or Firm* — Fitzpatrick, Cella, Harper & Scinto

(57) ABSTRACT

An electron beam apparatus is provided having an electron emitting device which has a simple configuration, exhibits high electron emission efficiency, operates stably, and in which emitted electrons are effectively converged. The electron beam apparatus includes: an insulator having a notch on its surface; a gate positioned on the surface of the insulator; at least one cathode having a protruding portion protruding from an edge of the notch toward the gate, and positioned on the surface of the insulator so that the protruding portion is opposed to the gate; and an anode arranged to be opposed to the protruding portion via the gate, wherein the gate is formed on the surface of the insulator so that at least a part of a region opposed to the cathode is projected outward and recessed portions are provided in which ends of the gate are recessed and interpose the projected region.

5 Claims, 30 Drawing Sheets

ELECTRON EMITTING DEVICE AND IMAGE DISPLAYING APPARATUS USING THE SAME

BACKGROUND OF THE INVENTION

1. Field of the Invention

The present invention relates to an electron beam apparatus having an electron emitting device that emits electrons, which is used in flat panel displays.

2. Description of the Related Art

In the related art, there are known electron emitting devices in which a number of electrons emitted from a cathode are extracted after they scatter and collide with a gate opposed to the cathode. As devices emitting electrons in such a manner, surface conduction type electron emitting devices and laminated electron emitting devices are known. For example, Japanese Patent Application Laid-Open No. 2000-251643 describes a high-efficiency electron emitting device in which a gap of an electron emitting portion is 5 nm or less. Moreover, Japanese Patent Application Laid-Open No. 2001-229809 describes a laminated electron emitting device, in which the condition for achieving high electron emission efficiency is expressed as a function of gate material thickness, driving voltage, and insulating layer thickness. Furthermore, Japanese Patent Application Laid-Open No. 2001-167693 describes a laminated electron emitting device having a configuration in which a notch (recess) is provided to an insulating layer at the vicinity of an electron emitting portion.

However, the electron emitting devices described in the above-mentioned patent documents may require further improvement in electron emission efficiency and control over electron beam shape.

SUMMARY OF THE INVENTION

An object of the present invention is to provide an electron beam apparatus having an electron emitting device which has a simple configuration, exhibits high electron emission efficiency, operates stably, and is excellent in terms of control over electron beam shape. Another object of the present invention is to provide an image displaying apparatus using such an electron beam apparatus.

According to an aspect of the present invention, there is provided an electron beam apparatus including: an insulating member having a notch on its surface; a gate positioned on the surface of the insulating member; at least one cathode having a protruding portion protruding from an edge of the notch toward the gate, and positioned on the surface of the insulating member so that the protruding portion is opposed to the gate; and an anode arranged to be opposed to the protruding portion via the gate, wherein the gate is formed on the surface of the insulating member so that at least a part of a region opposed to the cathode is projected outward and recessed portions are provided in which gate ends are recessed and interpose the projected region.

According to another aspect of the present invention, there is provided an image displaying apparatus including: the electron beam apparatus as described in the above aspect of the present invention; and light-emitting members positioned outside the anode.

According to the aspects of the present invention, since the recessed portion is provided to the gate, the number of emitted electrons colliding with the bottom surface of the gate can be reduced, and thus the electron emission efficiency can be increased. Therefore, the image displaying apparatus using the electron beam apparatus of the present invention can achieve a stable display of high-quality images.

Further features of the present invention will become apparent from the following description of exemplary embodiments with reference to the attached drawings.

DESCRIPTION OF THE EMBODIMENTS

The exemplary embodiments of the present invention will now be described with reference to the attached drawings. Note that, the scope of the present invention is not limited in size, quality, shape, relative arrangement, and the like of constitution parts described in this embodiment in the case where, in particular, no specific description is made.

General Configuration

First Embodiment

An electron beam apparatus of the present embodiment includes an electron emitting device that emits electrons and an anode at which the electrons emitted from the electron emitting device arrive.

Figure 1A:
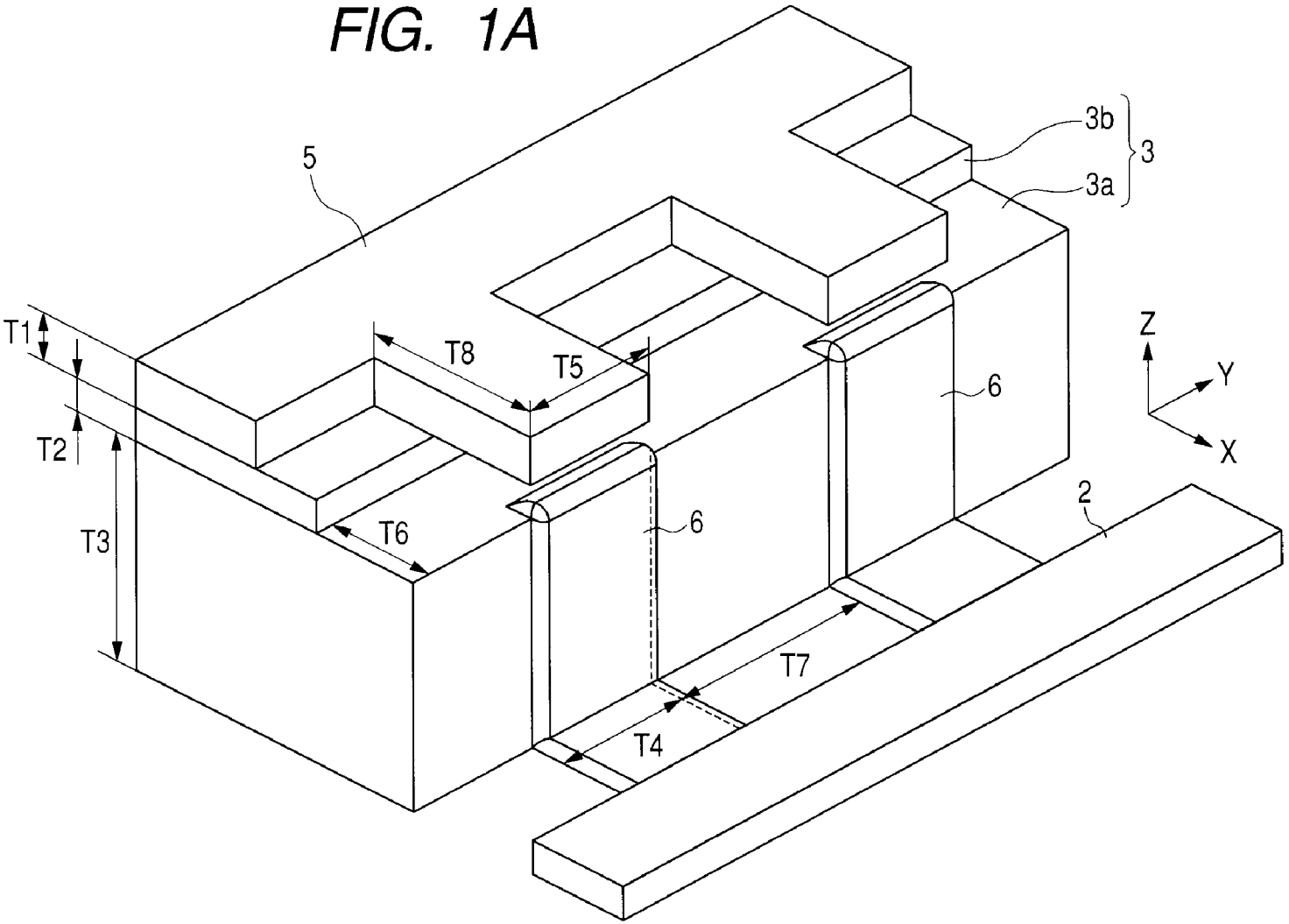
FIG. 1A is a perspective view schematically illustrating a configuration of an electron emitting device of an electron beam apparatus according to an embodiment of the present invention.
Figure 1B:
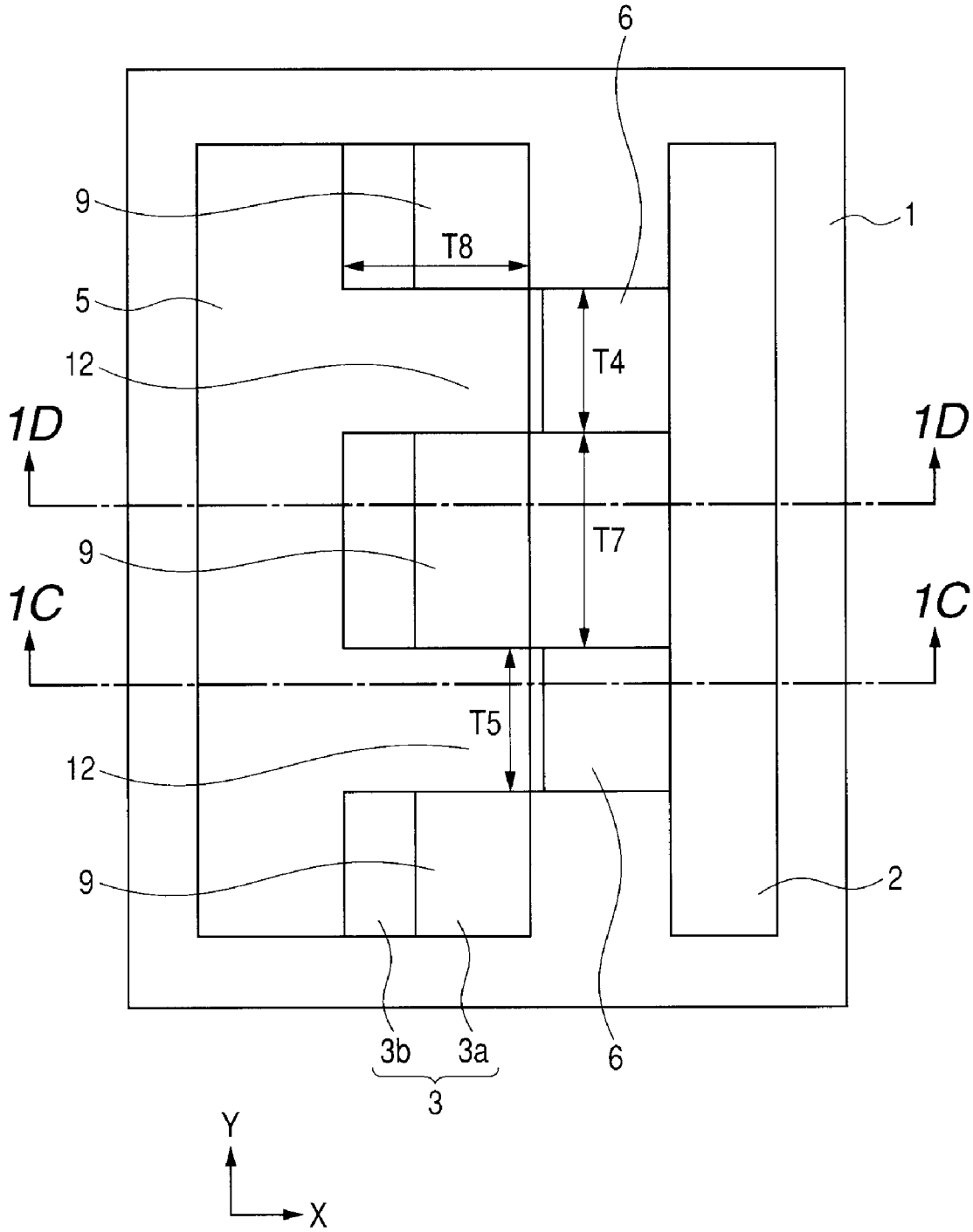
FIG. 1B is a schematic plane view of the electron emitting device illustrated in FIG. 1A.
Figure 1C:
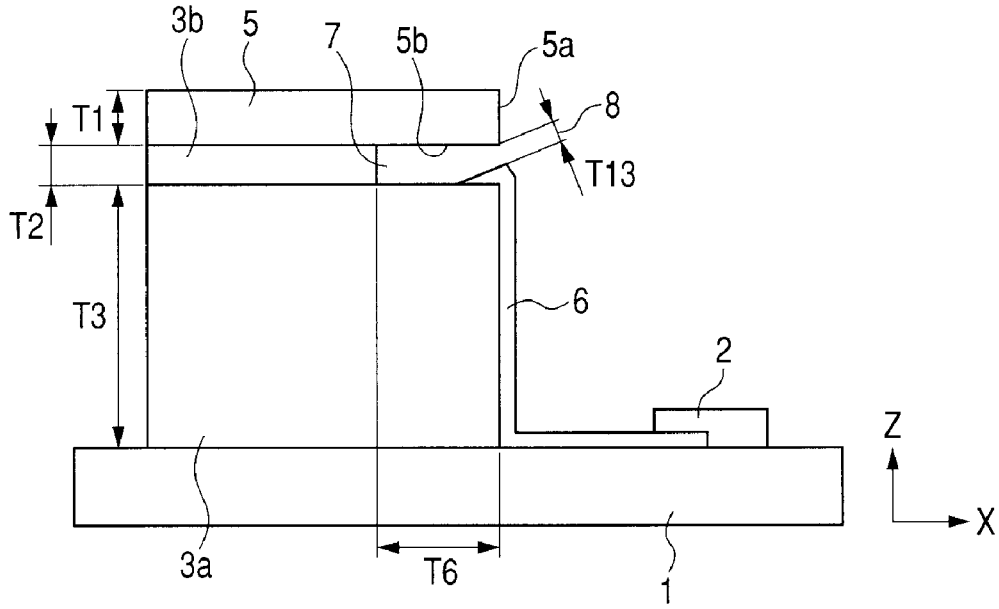
FIG. 1C is a schematic cross-sectional view of the electron emitting device, taken along the line 1C-1C in FIG. 1B.
Figure 1D:
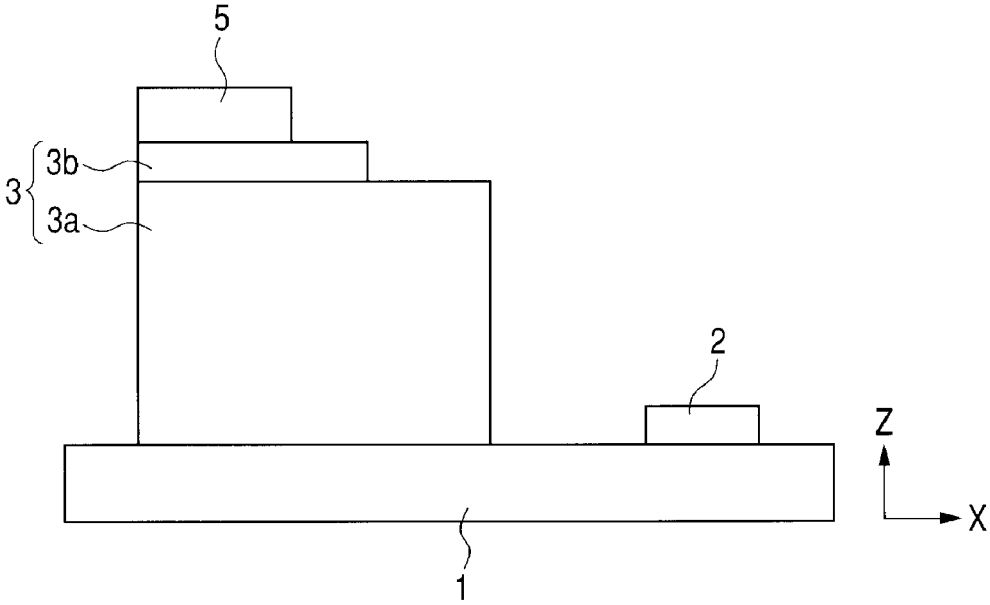
FIG. 1D is a schematic cross-sectional view of the electron emitting device, taken along the line 1D-1D in FIG. 1B.

FIGS. 1A to 1D are schematic views illustrating the configuration of an electron emitting device of an electron beam apparatus according to the first embodiment of the present invention. Specifically, FIG. 1A is a perspective view, FIG. 1B is a plane view, FIG. 1C is a cross-sectional view taken along the line 1C-1C in FIG. 1B, and FIG. 1D is a cross-sectional view taken along the line 1D-1D in FIG. 1B.

In FIGS. 1A to 1D, the electron emitting device includes a substrate 1, an electrode 2, and an insulating member 3 which is a laminated structure of insulating layers 3*a* and 3*b*. The electron emitting device further includes a gate 5 and a cathode 6. The cathode 6 is electrically connected to the electrode 2. Referring to FIG. 1C, the gate 5 has a side surface 5*a* and a bottom surface 5*b* which is exposed to a notch 7 of the gate 5. In this embodiment, the notch 7 is a notch in the insulating member 3 and is formed in this example such that a side surface of the insulating layer 3*b* is recessed towards an inner side more than a side surface of the insulating layer 3*a*. A gap 8 is defined which is a shortest distance between an end of the cathode 6 and the bottom surface 5*b* of the gate 5, and in which an electric field necessary for electron emission is formed.

In the electron emitting device according to the present embodiment, as illustrated in FIGS. 1A to 1D, the gate 5 is formed on a surface (in this example, an upper surface) of the insulating member 3. On the other hand, the cathode 6 is also formed on the surface (in this example, a side surface) of the insulating member 3. The cathode 6 has a protruding portion that is disposed on a side opposed to the gate 5 which interposes the notch 7 so as to protrude from an edge of the notch 7 toward the gate 5. Therefore, the cathode 6 is opposed to the gate 5 at the protruding portion via the gap 8. In the present embodiment, the cathode 6 is maintained at a lower potential than the gate 5. Although not illustrated in FIGS. 1A to 1D, the electron emitting device has an anode which is disposed at such a position as to be opposed to the cathode 6 via the gate 5, and which is maintained to be at a higher potential than the gate 5 and the cathode 6. In an image displaying apparatus using the electron beam apparatus of the present embodiment, light-emitting members are arranged outside the anode, which is opposed to the side on which the electron emitting device is positioned.

In the present embodiment, at least one cathode 6 is formed in one device, and preferably, two or more cathodes are provided as described later. In this example, a case is illustrated where two cathodes are provided.

The gate 5 is formed on the surface of the insulating member 3 so that at least a part of a region opposed to the cathode 6 is projected outward and convex/concave-shaped ends are provided which serve as recessed portions 9 in which both ends of the gate 5 are recessed and interpose the projected region 12. That is to say, an end of the projected region 12 corresponding to a convex part of the convex/concave shape is opposed to the cathode 6, and a region corresponding to a concave part is the recessed portion 9. When a plurality of cathodes 6 are provided, the gate 5 has a comb teeth-like shape as illustrated in FIG. 1B. In this example, a case is illustrated where a width T5 of the projected region 12 of the gate 5 interposed by the recessed portions 9 is the same as a width T4 of the cathode 6.

Figure 2A:
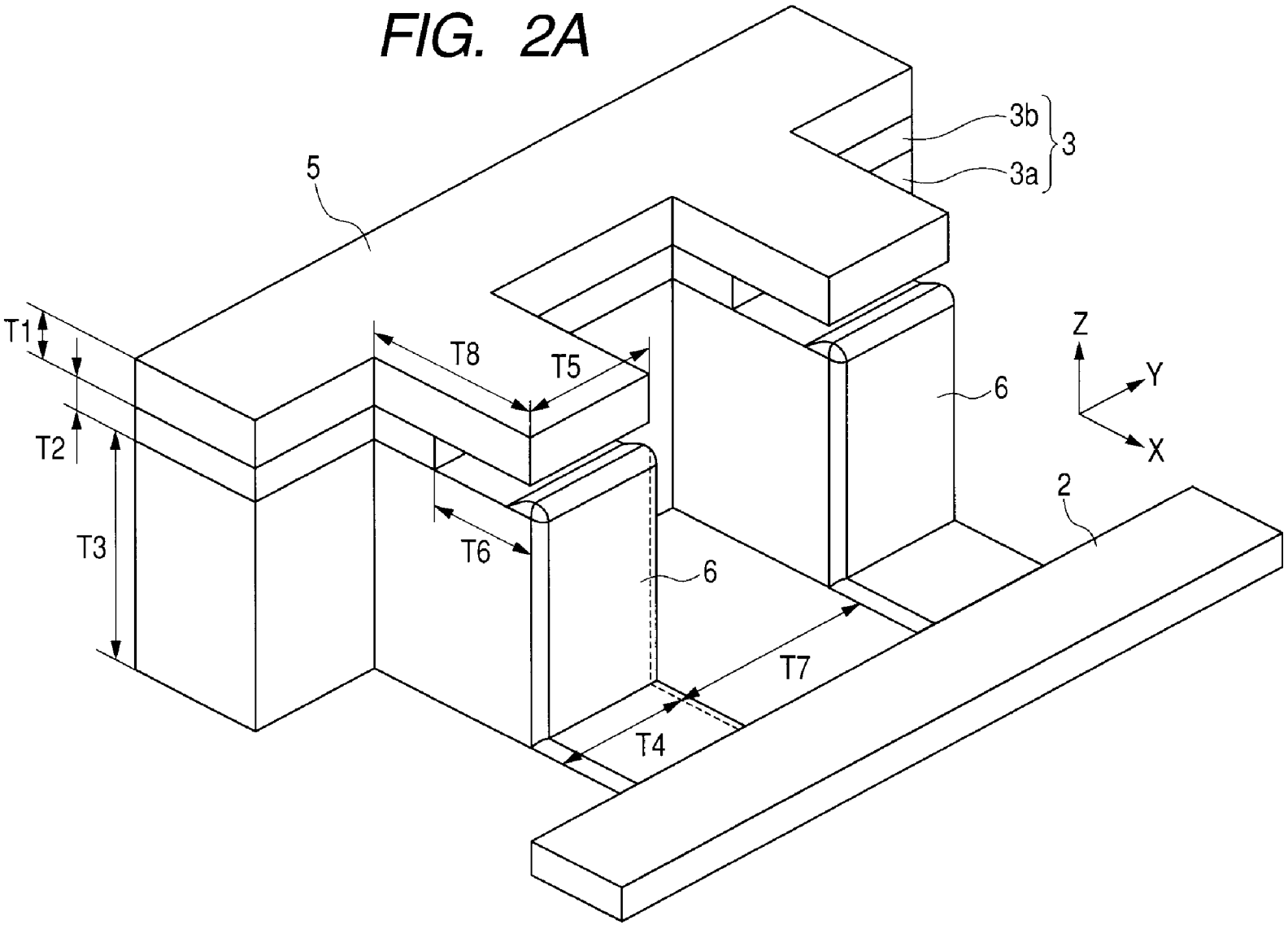
FIG. 2A is a perspective view schematically illustrating a configuration of an electron emitting device of an electron beam apparatus according to another embodiment of the present invention.
Figure 2B:
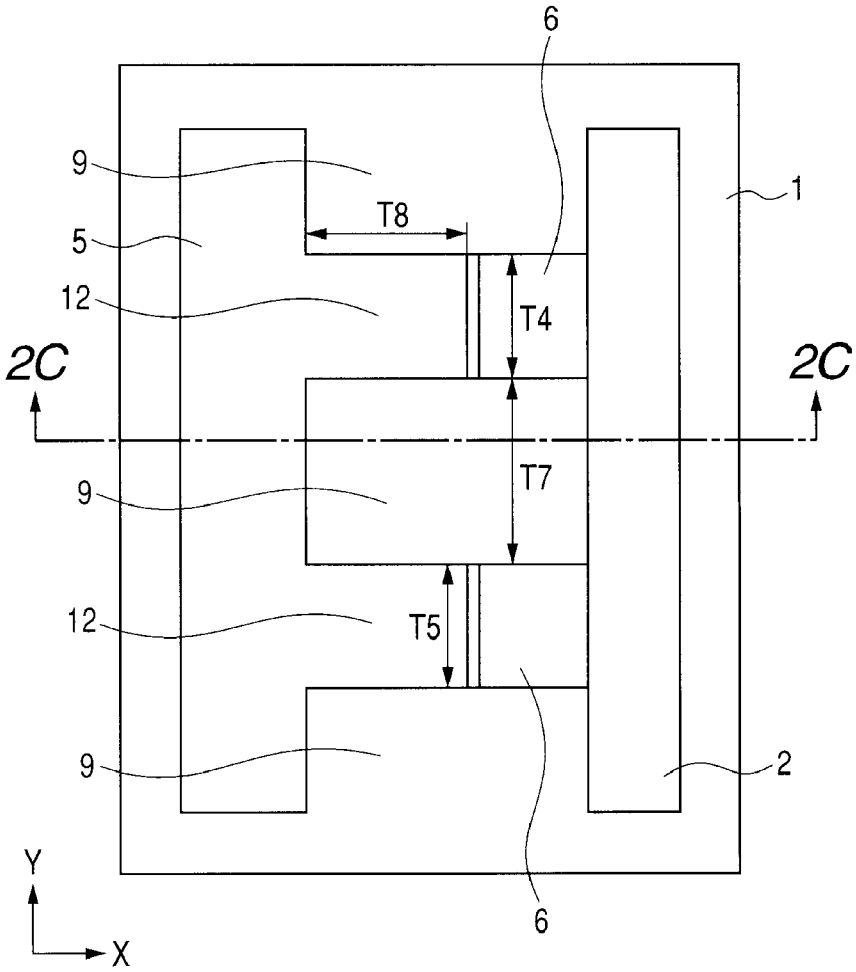
FIG. 2B is a schematic plane view of the electron emitting device illustrated in FIG. 2A.
Figure 2C:
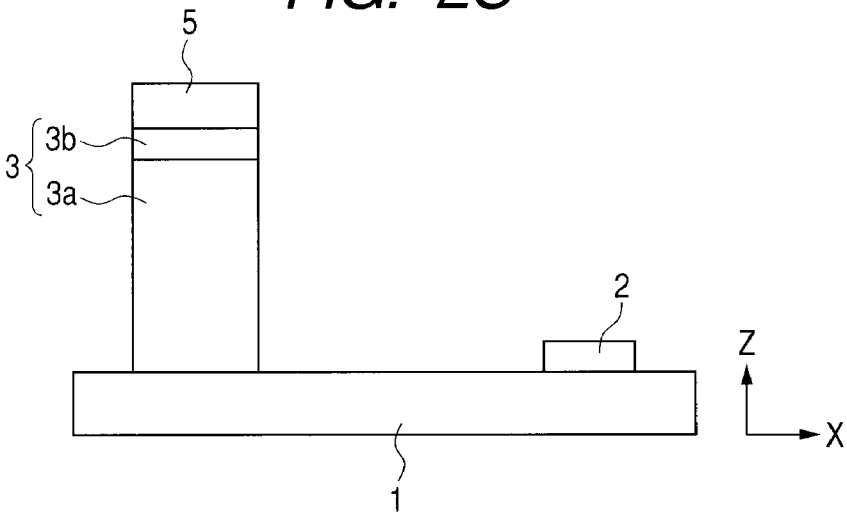
FIG. 2C is a schematic cross-sectional view of the electron emitting device, taken along the line 2C-2C in FIG. 2B.
Figure 20:
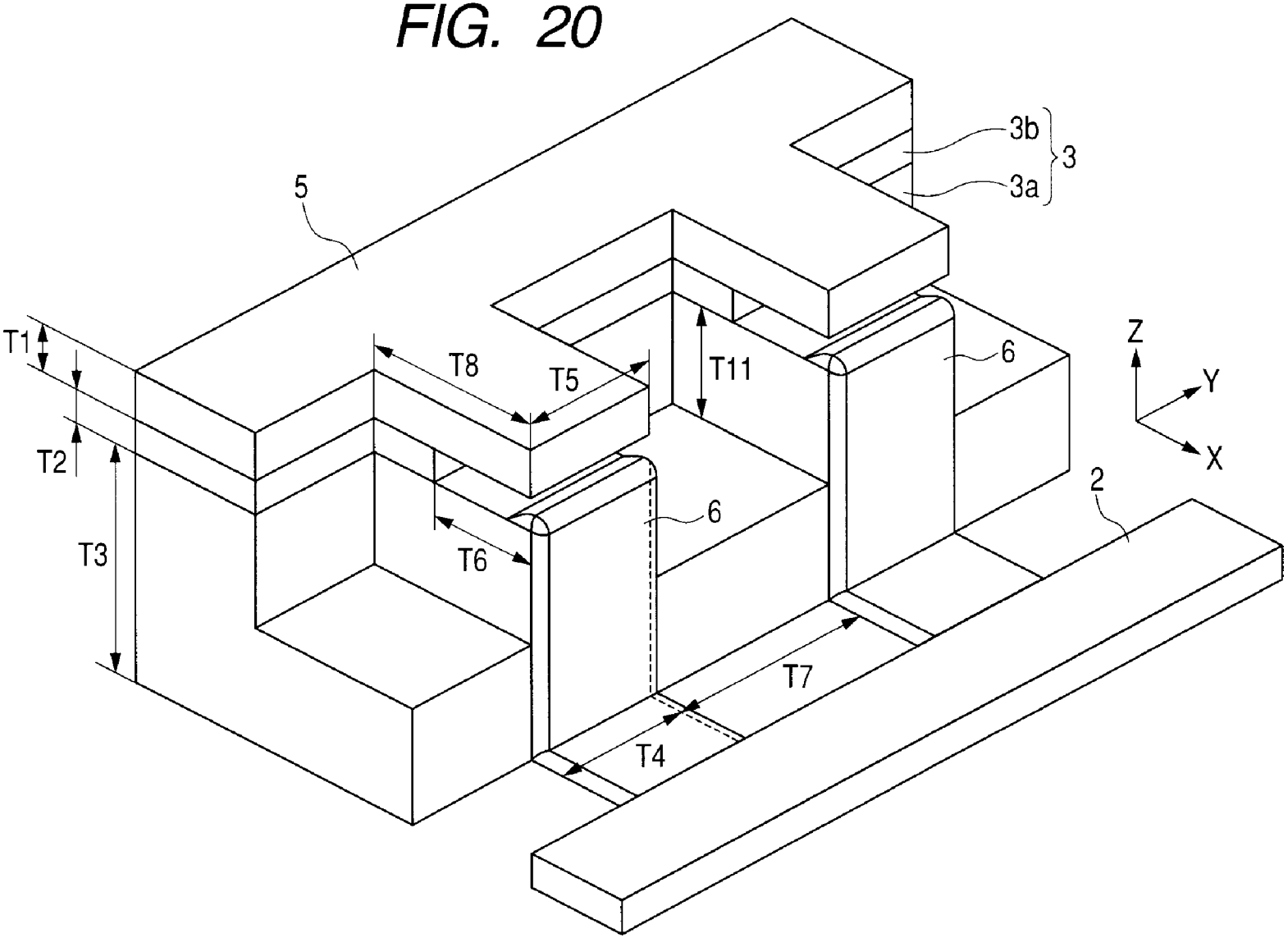
FIG. 20 is a perspective view illustrating another exemplary configuration of the electron emitting device of the electron beam apparatus according to the embodiment of the present invention.

In the electron emitting device illustrated in FIGS. 1A to 1D, although the side surface of the insulating member 3 corresponding to the recessed portion 9 of the gate 5 is not recessed inward in the same way as the recessed portion 9, the present invention is not limited to this. For example, as illustrated in FIGS. 2A to 2C, a part of the insulating member 3 corresponding to the recessed portion 9 (which overlaps the recessed portion 9) may be formed so that a side surface thereof is recessed inward in the same way as the recessed portion 9. Moreover, as illustrated in FIG. 20, only a part of the insulating member 3 (in FIG. 20, above the insulating layers 3*b* and 3*a*) may be formed so that an end thereof is recessed inward in the same way as the recessed portion 9. FIG. 2A and FIG. 20 are respectively perspective views of the embodiments of the present invention, FIG. 2B is a plane view of FIG. 2A, and FIG. 2C is a cross-sectional view taken along the line 2C-2C in FIG. 2B.

In the present invention, a length of each member of the electron emitting device is defined as per below.

T1: height of the gate 5 in a laminating (or thickness) direction (Z direction) of the gate 5 and the insulating member 3

T2: height of the notch 7 of the insulating member 3 in the laminating direction (Z direction) of the gate 5 and the insulating member 3 (i.e., height of the insulating layer 3*b*)

T3: distance between an edge of the notch 7 of the insulating member 3 close to the cathode 6 and the substrate 1 in the laminating direction (Z direction) of the gate 5 and the insulating member 3 (i.e., height of the insulating layer 3*a*)

T4: width of the cathode 6 (i.e., length of the cathode 6 in a direction (Y direction) parallel to opposing edges of the gate 5 and the cathode 6)

T5: width of the projected region 12 of the gate 5 (i.e., length of the projected region 12 in the direction (Y direction) parallel to opposing edges of the gate 5 and the cathode 6)

T6: depth of the notch 7 (i.e., distance (X-direction length) between the side surface of the insulating layer 3*b* in the notch 7 and the side surfaces of the insulating layer 3*a* and the gate 5)

T7: distance between the cathodes 6 in case where a plurality of cathodes 6 are provided T8: recess distance of the recessed portion 9 (i.e., distance between the side surface of the gate 5 opposed to the cathode 6 and the side surface (which is positioned at the most recessed position) of the recessed portion 9, or X-direction length of the projected region 12 of the gate 5)

T13: shortest distance between an end of the cathode 6 and the gate 5

Effect of Recessed Portion 9

Figure 3A:
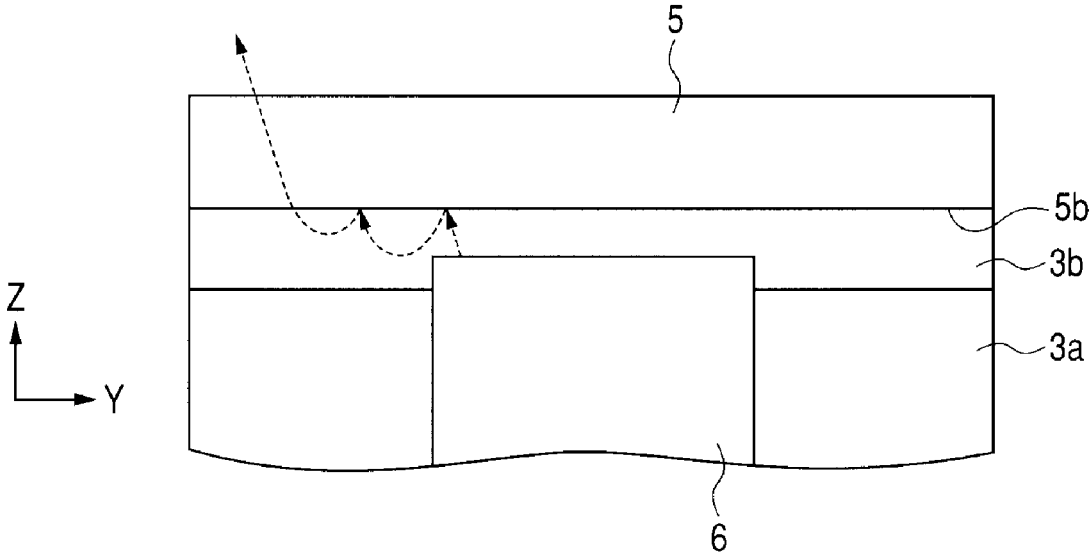
FIG. 3A is a schematic view illustrating the trajectory of an emitted electron in an electron emitting device having a configuration such that a recessed portion is not provided to its gate.
Figure 3B:
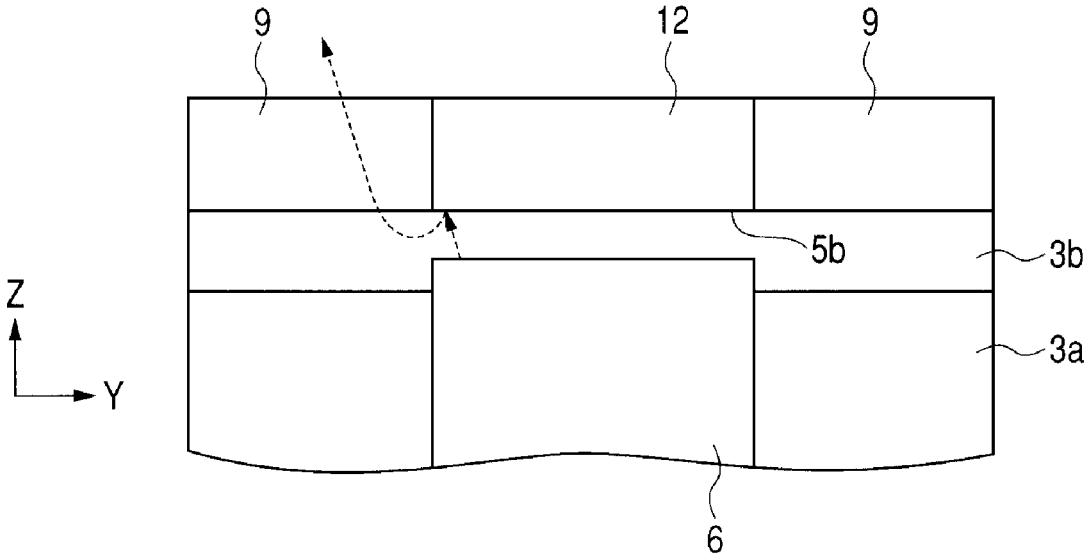
FIG. 3B is a schematic view illustrating the trajectory of an emitted electron in the electron emitting device illustrated in FIG. 1A.

Description of the effect of the recessed portion 9 in the present invention will be provided. FIG. 3A illustrates an enlarged schematic view, seen from the side of the electrode 2, of the opposing portions of the cathode 6 and the gate 5 in a device having such a configuration that the recessed portion 9 is not provided and the gate 5 is wider than the cathode 6 (T4<T5). FIG. 3B illustrates a corresponding view of the device illustrated in FIG. 1A.

As illustrated in FIG. 3A, when the recessed portion 9 is not provided and the gate 5 is wider than the cathode 6 in a region of the gate 5 opposed to the cathode 6, electron emitted from the proximity of a widthwise end of the cathode 6 are scattered isotropically at the bottom surface 5*b* of the gate 5 as depicted by the broken line in the drawing. Some of the scattering electrons collide again with the gate 5, thus scattering is repeated.

On the other hand, according to the present embodiment, as illustrated in FIG. 3B, since the recessed portions 9 are formed at both sides of a region of the gate 5 opposed to the cathode 6, and thus the gate 5 does not exist in the recessed portions 9, the number of electrons scattering and colliding with the bottom surface 5*b* of the gate 5 becomes smaller than that in the configuration of FIG. 3A. Therefore, in the present configuration, the number of electrons traveling toward the anode via the recessed portions 9 will increase, and thus the electron emission efficiency of the emitted electrons is improved.

Recess Distance T8

The recess distance T8 of the recessed portion 9 obviously contributes to improvement of the electron emission efficiency since the larger the recess distance, an area where electrons collide will decreases. However, a smaller recess distance is advantageous from the viewpoint of reducing the tact time of a process of forming the recessed portion 9 in the gate 5. A calculation result of simulation of the relationship between the recess distance T8 of the recessed portion 9 of the gate 5 and the electron emission efficiency is graphically shown in FIG. 4.

Figure 4:
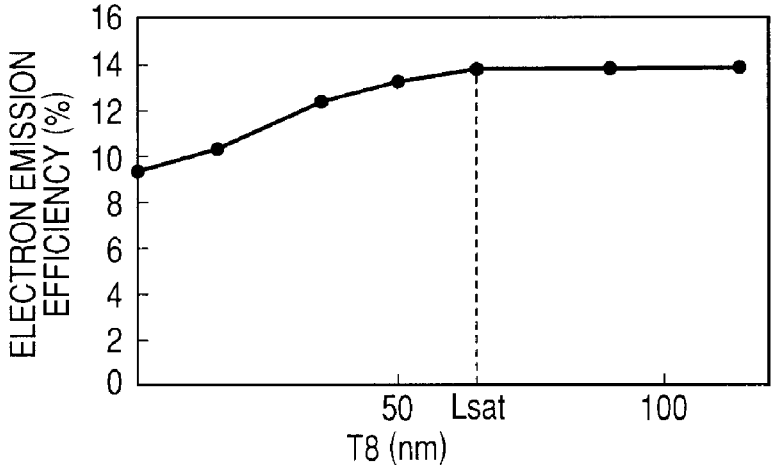
FIG. 4 is a graph showing the relationship between a recess distance T8 and electron emission efficiency.

In FIG. 4, the horizontal axis represents the recess distance T8 of the recessed portion 9, and the vertical axis represents the electron emission efficiency. It can be seen from FIG. 4 that the electron emission efficiency increases as the recess distance T8 of the gate 5 increases; however, it reaches its saturation point at a certain value or higher. This means that the number of electrons traveling up to the recessed portion 9 can be decreased by providing the recessed portion 9 with a width increased to a certain extent. Therefore, a further increase in the recess distance T8 may not have any effect on the improvement in the electron emission efficiency.

Here, a minimum value of the recess distance T8 at which increases in the electron emission efficiency are saturated will be referred to as Lsat, and an expression of Lsat will be discussed.

First, considering a case where the recessed portion 9 is not provided (T8=0), some of the electrons emitted from the cathode 6 will scatter and collide with the bottom surface 5*b* of the gate 5 and travel through the notch 7. If it is assumed that an electric field produced by a driving voltage Vf across parallel flat-plate electrodes is uniform, the mean free path of the electrons at that moment can be derived as follows.

Figure 5:
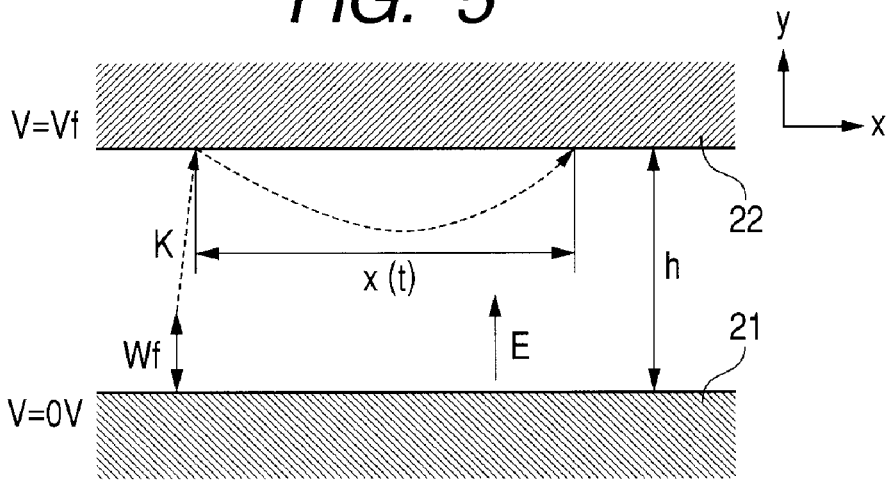
FIG. 5 is a schematic view illustrating the mean free path of an electron between parallel flat-plate electrodes.

First, as illustrated in FIG. 5, an upper electrode film is formed such that potentials of V=0 [V] and V=Vf [V] are respectively applied to two electrodes 21 and 22 separated by a distance h on the XY plane. Here, a traveling distance of scattering electrons which have been emitted at a position offset by a work function Wf [eV] from the electrode 21 at V=0 [V] and have collided with the electrode 22 at V=Vf [V] will be considered. If it is assumed that an amount of charge of one electron is e [C], mass of one electron is m [kg], a kinetic energy of one electron is K [$kg \cdot m^2/s^2$], an electric field intensity is E [V/m], a magnitude of velocity of the electron is v [m/s], an acceleration of the electron is a [$m/s^2$], an x-directional velocity of the electron is vx [m/s], a y-directional velocity of the electron is vy [m/s], and energy when one electron is accelerated by voltage Vf is EVf [eV]=e×Vf, then the following expressions are obtained.

$$K=(1/2)\times m\times v^2 \tag{1}$$

$$ma=eE \tag{2}$$

From the expressions (1) and (2), the following expressions are obtained.

$$v=(2K/m)^{1/2} \tag{3}$$

$$a=eE/m \tag{4}$$

Moreover, y and x-directional displacements at a time t can be expressed by the following expressions, respectively.

$$y(t)=vy\times t+(1/2)\times a\times t^2 \tag{5}$$

$$x(t)=vx\times t \tag{6}$$

From the expression (5), the time at which y(t) becomes 0 is calculated as follows.

$$t=-2\times(vy/a) \tag{7}$$

When the expression (7) is substituted into the expression (6), the following expression is obtained.

$$x=-2\times vx\times(vy/a) \tag{8}$$

In the expression (8), x becomes the maximum when $vx=v/2^{1/2}$ and $vy=-v/2^{1/2}$. Therefore, the following expression is obtained.

$$x=v\times(v/a)=(2\times K/m)/(eE/m)=2K/(e\times E) \tag{9}$$

Here, when E and K are substituted with E=Vf/h and K=EVf−Wf, the following expression is obtained.

$$x=2\times h\times\{1-(Wf/EVf)\} \tag{10}$$

When the recessed portion 9 is provided, the electric field becomes weaker, and thus electrons are able to travel further. A mean traveling distance when an amount of the effect of providing the recessed portion 9 to weaken the electric field is considered as a coefficient α is calculated as follows.

$$x'=\alpha\times x=2\alpha\times h\times\{1-(Wf/EVf)\} \tag{11}$$

In the expression (11), h corresponds to the height T2 of the insulating layer 3*b*, and it has been confirmed from the result of studies that a reasonable value of α is about 3. Therefore, the saturation amount Lsat of the recess distance T8 can be expressed as follows.

$$Lsat=6\times T2\times\{1-(Wf/EVf)\} \tag{12}$$

That is to say, in order to obtain a sufficient effect of increasing the electron emission efficiency, it is preferable that an expression T8≧6×T2×{1−(Wf/EVf)} is satisfied.

T4 and T5

In the description above, the configuration where the width T4 of the cathode 6 is the same as the width T5 of the projected region 12 of the gate 5 has been described. However, it is obvious from the effect of the recessed portion 9 that the effect of increasing the electron emission efficiency can be obtained even in the case of T4>T5.

However, in the case of T5>T4, electrons emitted from the cathode 6 will repeatedly be scattering before reaching the recessed portion 9 of the gate 5 since the gate 5 has a wider width than the cathode 6. Therefore, it is considered difficult to obtain the effect of increasing the electron emission efficiency.

Figure 6:
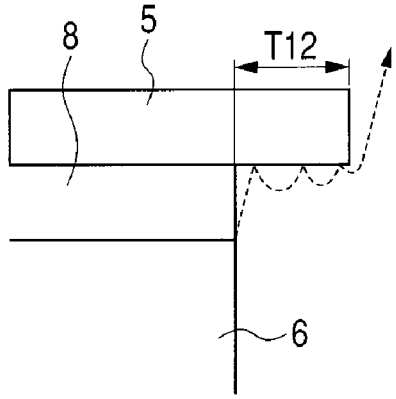
FIG. 6 is an enlarged schematic view of the proximity of a gap between a cathode and a gate.

From the discussions above, in order to obtain the effect of increasing the electron emission efficiency, if it is assumed that a shortest distance of the gap 8 illustrated in FIG. 1C is T13, and a length of a portion where the projected region 12 of the gate 5 illustrated in FIG. 6 protrudes from a region opposed to the cathode 6 is T12, it is preferable that an expression T12<T13 is satisfied.

Figure 7:
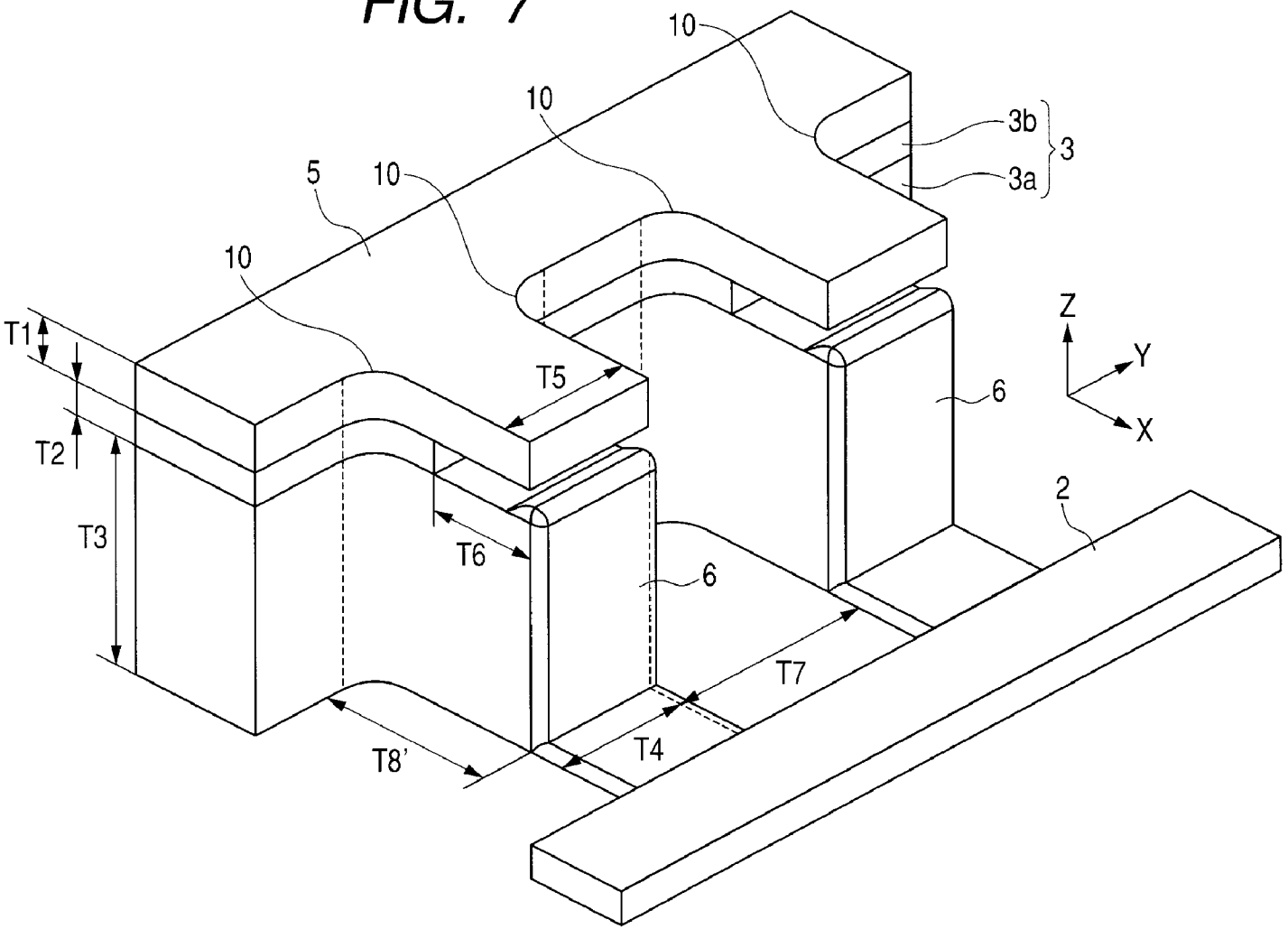
FIG. 7 is a perspective view illustrating another exemplary configuration of the electron emitting device of the electron beam apparatus according to the embodiment of the present invention.

In the drawings described above, although the corners when providing the recessed portion 9 to the gate 5 or the insulating member 3 are depicted as vertical corners, the corners may be configured as rounded corners (R portions) 10 as illustrated in FIG. 7. In such a configuration as illustrated in FIG. 7, the minimum recess distance T8 at which the increases in the electron emission efficiency are saturated is also expressed by the above-mentioned expression (12).

That is to say, a recess distance T8' at a sidewall of the gate 5 which is positioned at the most recessed position in FIG. 7 preferably satisfies an expression T8'≧6×T2×{1−(Wf/EVf)}.

Second Embodiment

Figure 27A:
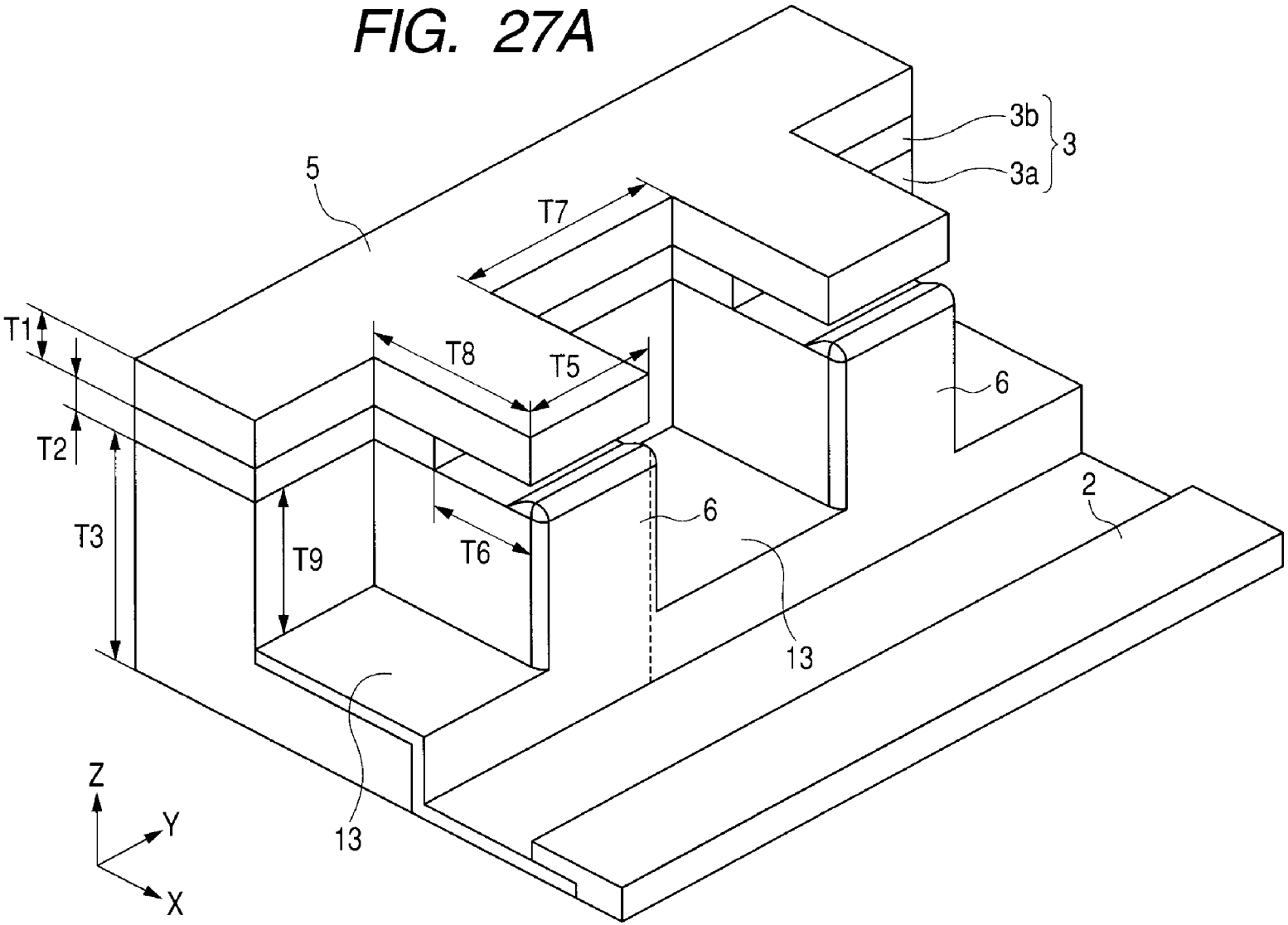
FIG. 27A is a perspective view schematically illustrating a configuration of an electron emitting device of an electron beam apparatus according to another embodiment of the present invention.
Figure 27B:
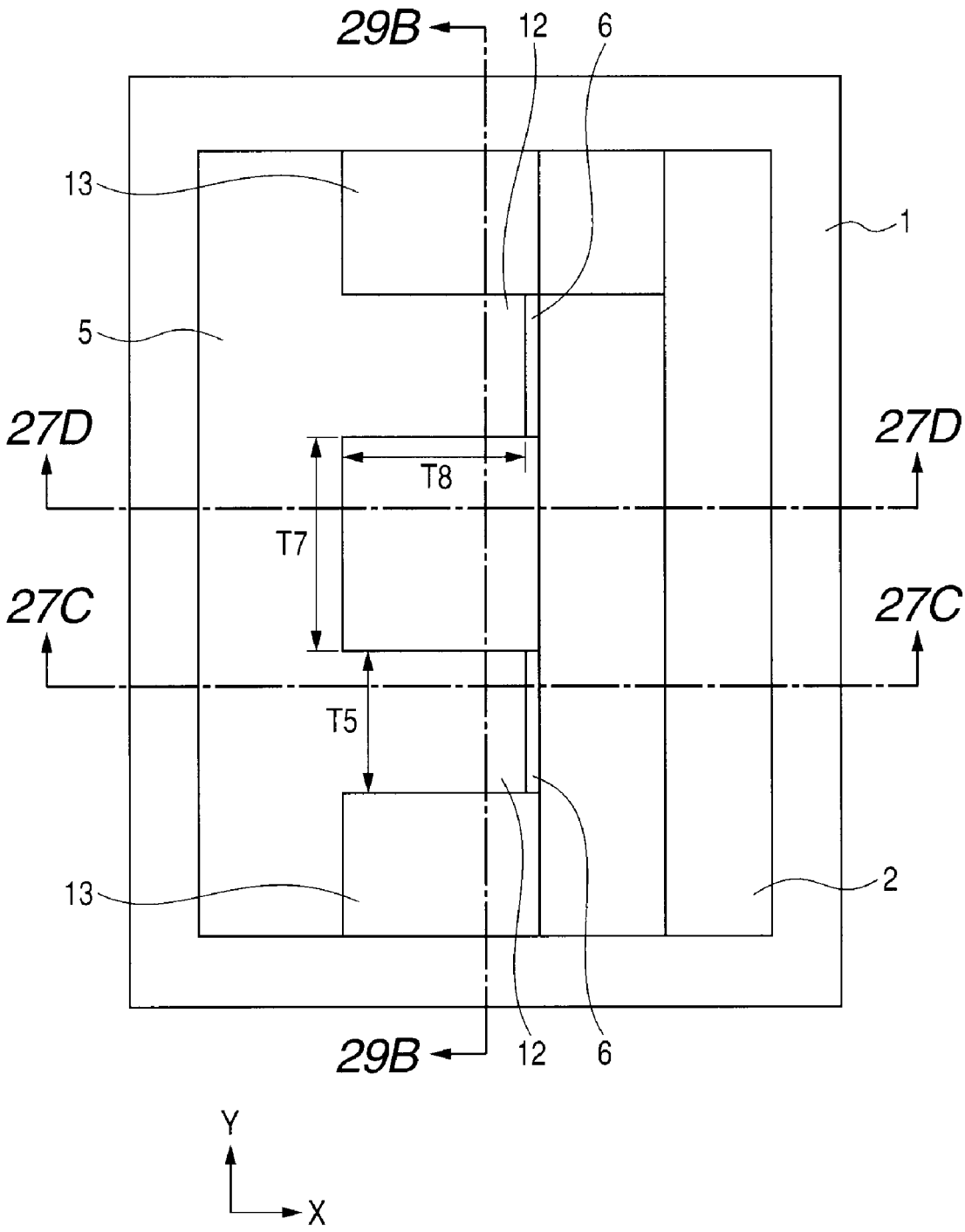
FIG. 27B is a schematic plane view of the electron emitting device illustrated in FIG. 27A.
Figure 27C:
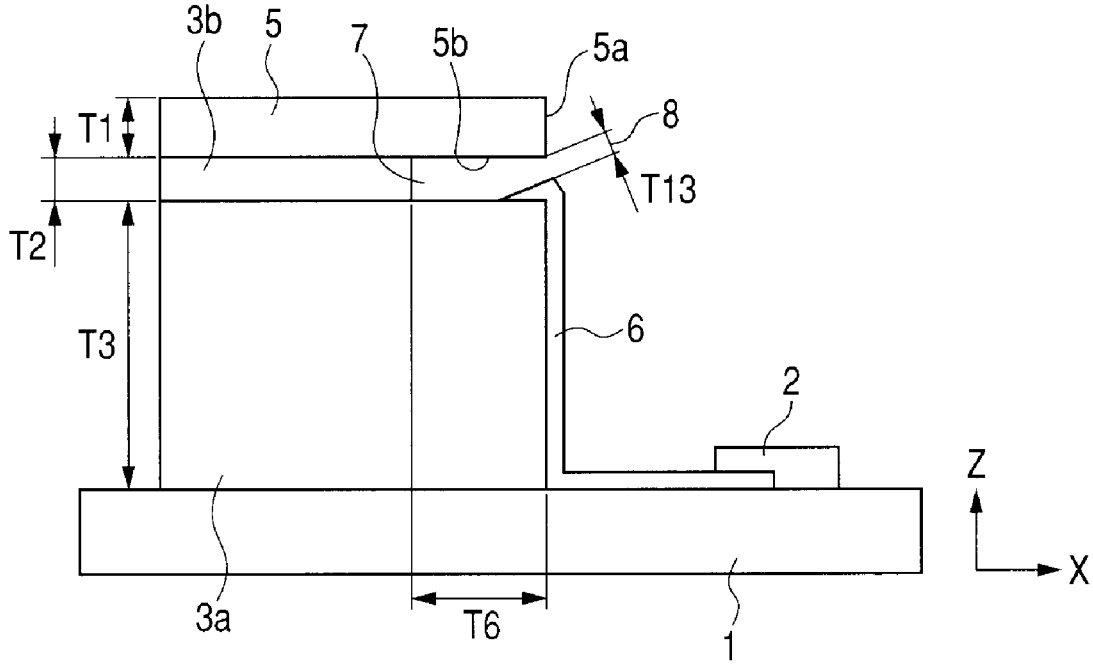
FIG. 27C is a schematic cross-sectional view of the electron emitting device taken along the line 27C-27C in FIG. 27B.
Figure 27D:
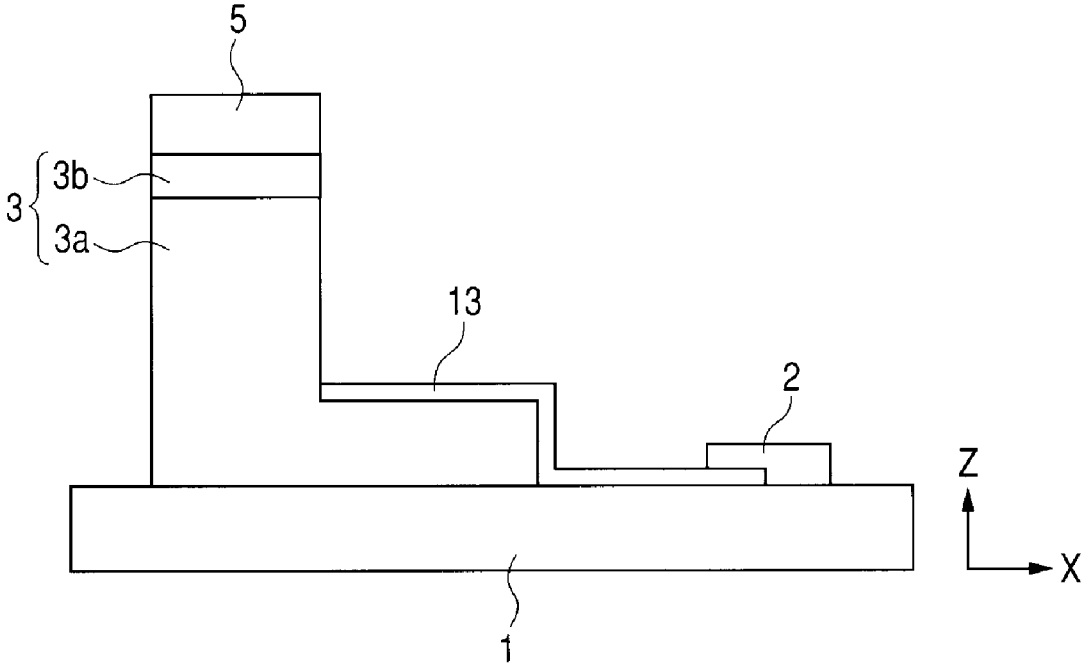
FIG. 27D is a schematic cross-sectional view of the electron emitting device taken along the line 27D-27D in FIG. 27B.

FIGS. 27A to 27D are schematic views illustrating the configuration of an electron emitting device of an electron beam apparatus according to the second embodiment of the present invention. Specifically, FIG. 27A is a perspective view, FIG. 27B is a plane view, FIG. 27C is a cross-sectional view taken along the line 27C-27C in FIG. 27B, and FIG. 27D is a cross-sectional view taken along the line 27D-27D in FIG. 27B.

Figure 28A:
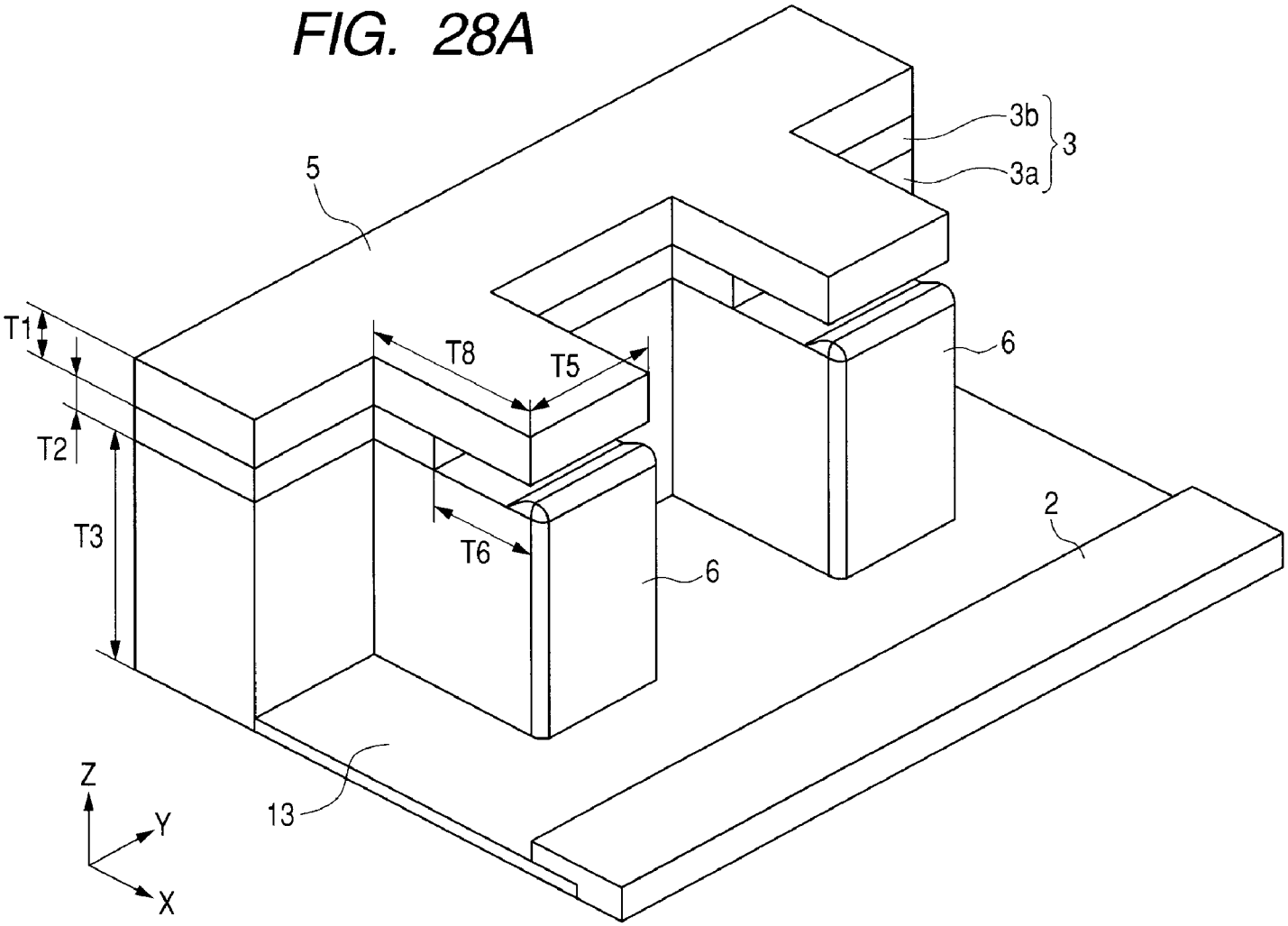
FIG. 28A is a perspective view schematically illustrating a configuration of an electron emitting device of an electron beam apparatus according to another embodiment of the present invention.
Figure 28B:
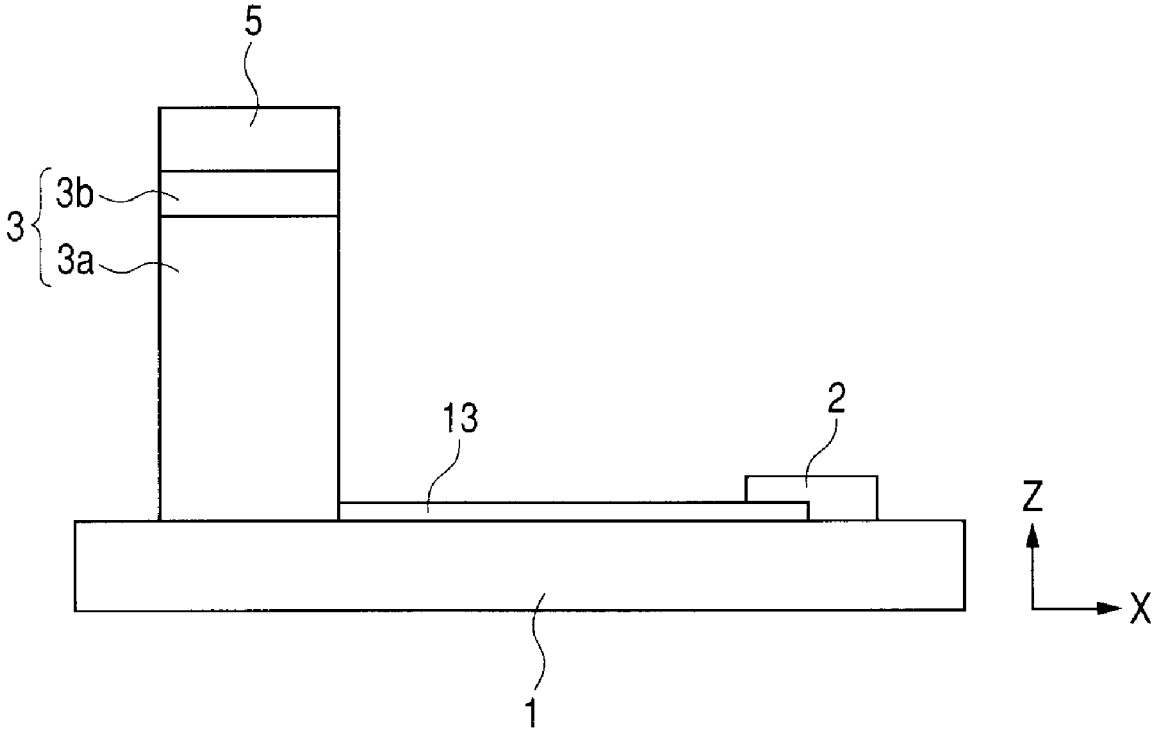
FIG. 28B is a schematic cross-sectional view of the electron emitting device illustrated in FIG. 28A.

In this embodiment, a surface of the insulating member 3 exposed to the recessed portion 9, that is, opposed to an anode 11 described later, is recessed so as to reach at least a cathode-side edge of the notch 7. That is to say, when the insulating member 3 is a laminated structure of the insulating layers 3*a* and 3*b*, the insulating layer 3*b* is removed in the recessed portion 9 so that the insulating layer 3*a* is exposed. Although this embodiment shows a configuration in which the surface of the insulating member 3 is recessed while having a part of the insulating layer 3*a* which has not been removed, an entire portion of the insulating member 3 exposed to the recessed portion 9 may be removed as illustrated in FIG. 28A. FIG. 28A is a perspective view of this embodiment, and a top plane view thereof is identical to FIG. 27B. FIG. 28B is a cross-sectional view of FIG. 28A, corresponding to the cross section taken along the line 27D-27D in FIG. 27B.

In this embodiment, a control electrode 13 is disposed in a region exposed to the recessed portion 9 (in this example, a surface in which a part of the insulating layer 3*a* is removed). Although the control electrode 13 may be formed to be electrically isolated from the cathode 6 so that potential can be controlled independently, the control electrode 13 is preferably formed to be continuous with the cathode 6 to make manufacturing processes simple and easy as illustrated in FIGS. 27A and 28A.

In this embodiment, the length of each member of the electron emitting device is defined as described above, and T9 and h are defined as follows.

T9: distance between an edge of the notch 7 of the insulating member 3 close to the cathode 6 and a surface of the control electrode 13 h: distance between a surface of the insulating member 3 opposed to a side where the gate is disposed and the anode (i.e., distance between the substrate 1 and the anode). Here, it should be noted that h in this embodiment is equivalent to H indicated in FIG. 9.

Effect of Providing Control Electrode 13 to Recessed Portion 9

Figure 29A:
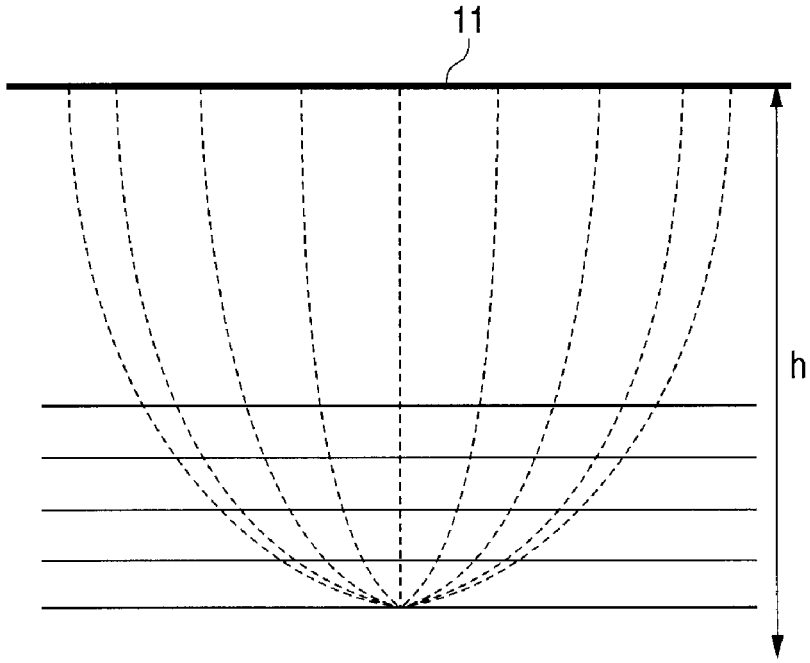
FIG. 29A is a schematic view illustrating the electron trajectory in a configuration where a gate is provided neither with a recessed portion nor a control electrode.
Figure 29B:
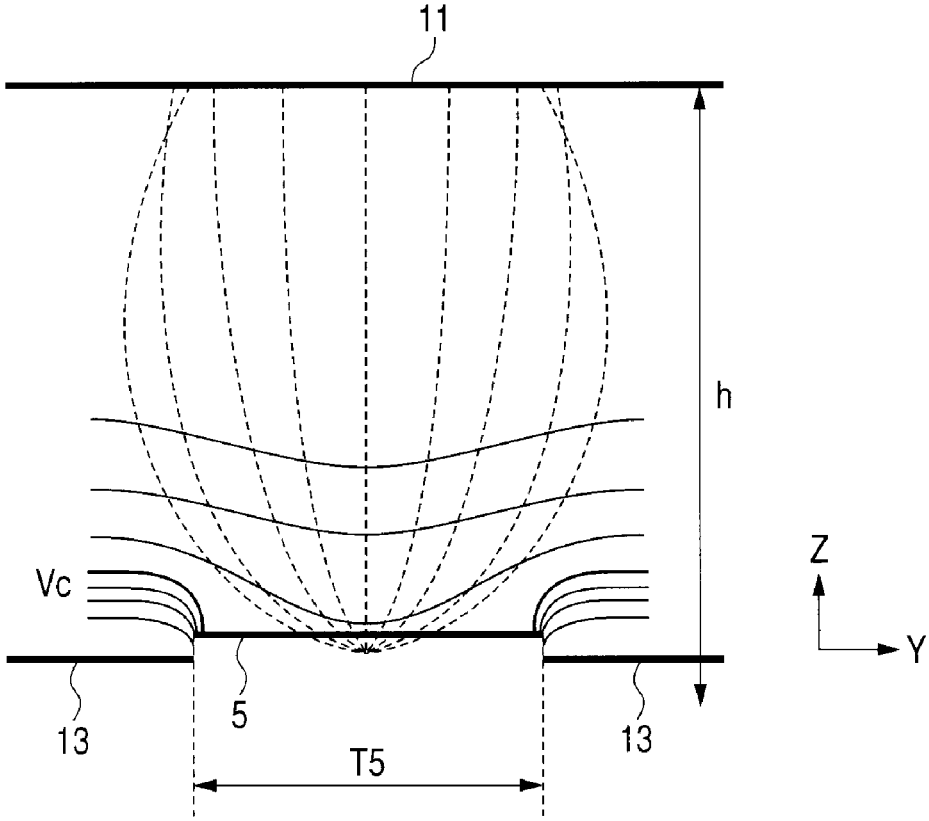
FIG. 29B is a schematic view illustrating the electron trajectory on a cross section taken along the line 29B-29B in FIG. 27B.

FIG. 29B illustrates the electron trajectory on a cross section taken along the line 29B-29B in FIG. 27B. FIG. 29A illustrates the electron trajectory in a configuration where the gate 5 is provided neither with the recessed portion 9 nor the control electrode 13. In FIGS. 29A and 29B, solid lines extending in the horizontal direction represent lines with equal potentials, and broken lines in the vertical direction of the drawing represent electron trajectories. Moreover, the anode is denoted by reference numeral 11.

As illustrated in FIG. 29A, in the configuration where neither the recessed portion 9 nor the control electrode 13 is provided, the potential rarely changes in the Y direction. Therefore, when the electron trajectories are observed from the X direction perpendicular to the YZ plane, electrons will travel along parabolic trajectories as illustrated in FIG. 29A due to only the influence of the anode 11 and a parallel electric field.

On the contrary, as illustrated in FIG. 29B, when the recessed portion 9 is provided to the gate 5 and the control electrode 13 is provided to the recessed portion 9, the lines with equal potential in the Y direction are distorted because of the presence of the control electrode 13 and the gate 5. Thus, electrons will travel along the trajectories as illustrated by the broken lines. That is to say, the electron beams are suppressed from spreading in the Y direction, and thus a converging effect appears.

Although a greater converging effect can be expected when a larger recess distance T8 of the recessed portion 9 is taken, a smaller recess distance T8 is advantageous from the viewpoint of reducing the tact time.

Figure 30:
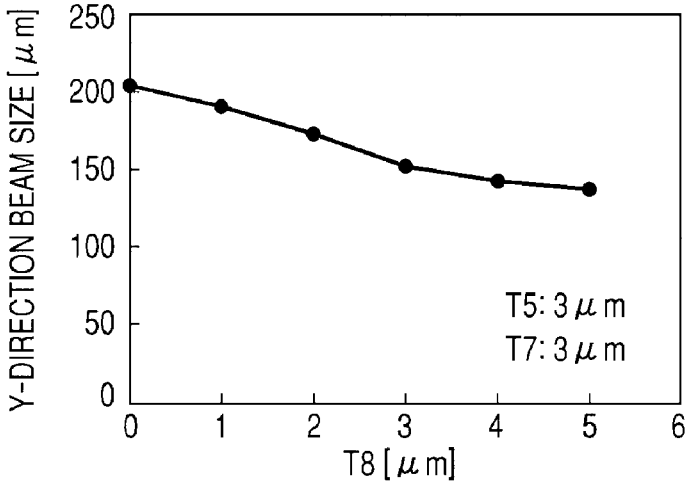
FIG. 30 is a graph showing the relationship between a recess distance T8 of a recessed portion and an electron beam size, according to the embodiment of the present invention.

The relationship between the recess distance T8 of the recessed portion 9 and the size of the electron beam in the Y-direction is graphically shown in FIG. 30. FIG. 30 shows a case where electrons are emitted from one location interposed by the recessed portions 9.

In FIG. 30, the horizontal axis represents the recess distance T8 of the recessed portion 9 of the gate 5, and the vertical axis represents the size of the electron beam in the Y-direction when electrons arrive at the anode 11. It can be seen from FIG. 30 that the size of the electron beam in the Y-direction decreases as the recess distance T8 of the recessed portion 9 of the gate 5 increases; however, it reaches its saturation point at a certain value or higher. This means that the number of electrons traveling up to the recessed portion 9 can be decreased by providing the recessed portion 9 with a width increased to a certain extent. Therefore, a further increase in the recess distance T8 may not contribute to a decrease in the size of the electron beam in the Y-direction.

T5

In the configuration of FIG. 27A, when the width T5 of the projected region 12 of the gate 5 decreases, the influence of an electric field generated by a potential difference between the control electrode 13 and the gate 5 becomes stronger. Thus, it is possible to expect improvement in the converging effect of the electron beams.

Figure 32:
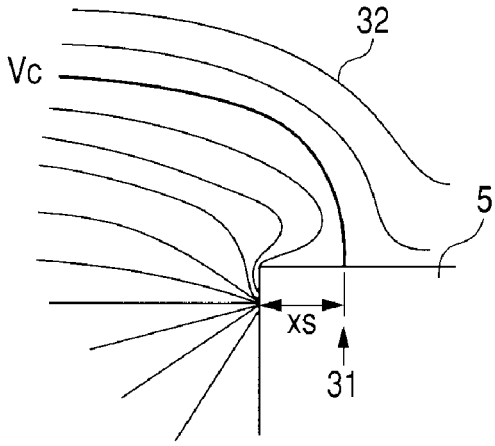
FIG. 32 is a partly enlarged view of the proximity of an end of the gate illustrated in FIG. 29B.

Description of this effect will be provided with reference to FIGS. 29B and 32. FIG. 32 is an enlarged schematic view of the proximity of the left end of the gate 5 in the drawing of FIG. 29B. According to the present embodiment, as illustrated in FIGS. 29B and 32, the curves with equal potentials are distorted because of the relationship between (1) a potential difference Vc between the gate 5 and the control electrode 13 and (2) a potential difference Va between the anode 11 and the cathode 6. Thus, lines with equal potentials of V=Vc are pulled into the gate 5 by a distance xs. The xs point is a position at which a Z-directional electric field becomes 0, and at which an electric field by the potential difference Vc (1) and an electric field by the potential difference Va (2) are in an equilibrium state. The degree of pulling of the potential Vc changes depending on Vc, Va, h, and the like, and can be expressed as below.

$$xs=(Vc/Va)\times(h/\pi)$$

Here, n is the circular constant. When T5 is small relative to xs, an increase in the converging effect of the electron beams can be expected.

Figure 31:
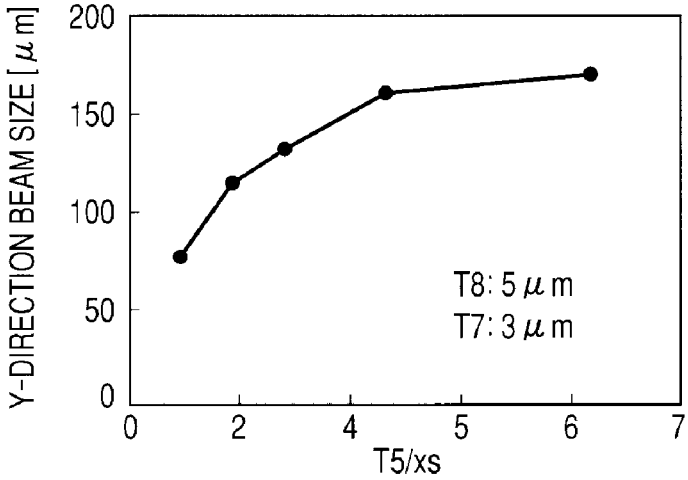
FIG. 31 is a graph showing the relationship between a width T5 of a projected region of a gate and an electron beam size.

It was observed that when T5 is decreased, the size of the electron beam in the Y-direction decreases as T5 becomes smaller than a certain value. This tendency is graphically shown in FIG. 31. In FIG. 31, the horizontal axis is T5/*xs*. It can be seen from FIG. 31 that the effect of converging the size of the electron beam in the Y-direction appears at T5/*xs*<5.

That is to say, in the present embodiment, it is necessary to satisfy the following expressions.

$$T5<5\times(Vc/Va)\times(h/\pi)$$

$$Vf\geqq Vc$$

It was also observed that the size of the electron beam in the Y-direction was about 300 μm in case of T5=100 μm and the size of the electron beam in the Y-direction showed a gradual decrease as T5 was decreased to 9 μm, 5 μm, 3 μm, and so on.

Figure 9:
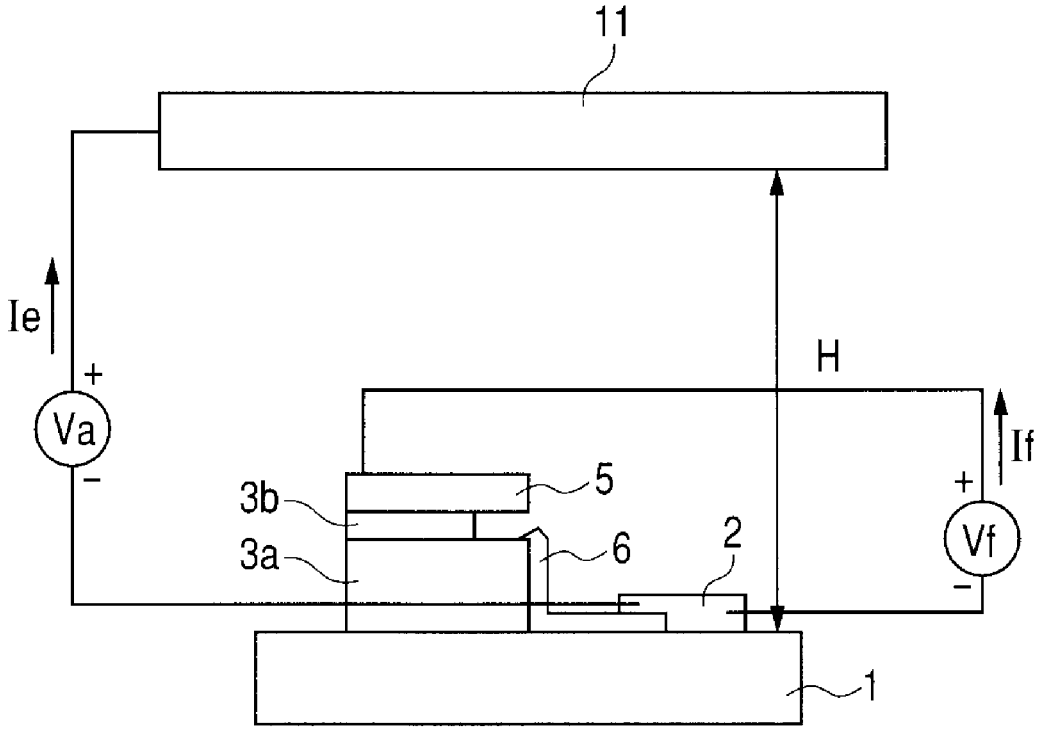
FIG. 9 is a schematic view illustrating a configuration for measuring the electron emission characteristics of the electron beam apparatus according to the embodiment of the present invention.

The size of the electron beam in the Y-direction also changes when the applied voltages Va and Vf change in FIG. 9. The relationship between Va and Vf and the size of the electron beam in the Y-direction is graphically shown in FIGS. 33A and 33B.

Figure 33A:
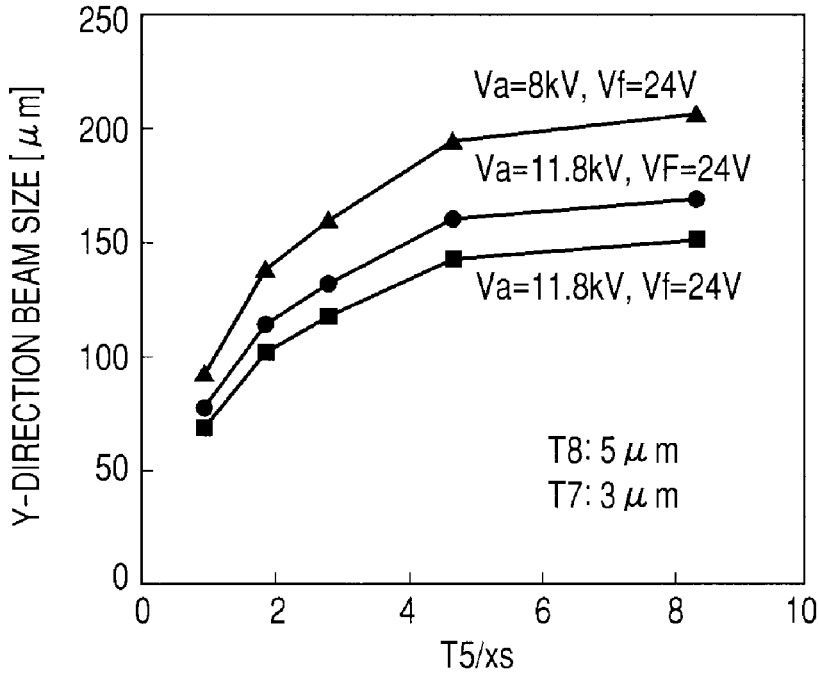
FIG. 33A is a graph showing the relationship between Va, Vf, and an electron beam size in the electron beam apparatus according to the embodiment of the present invention.
Figure 33B:
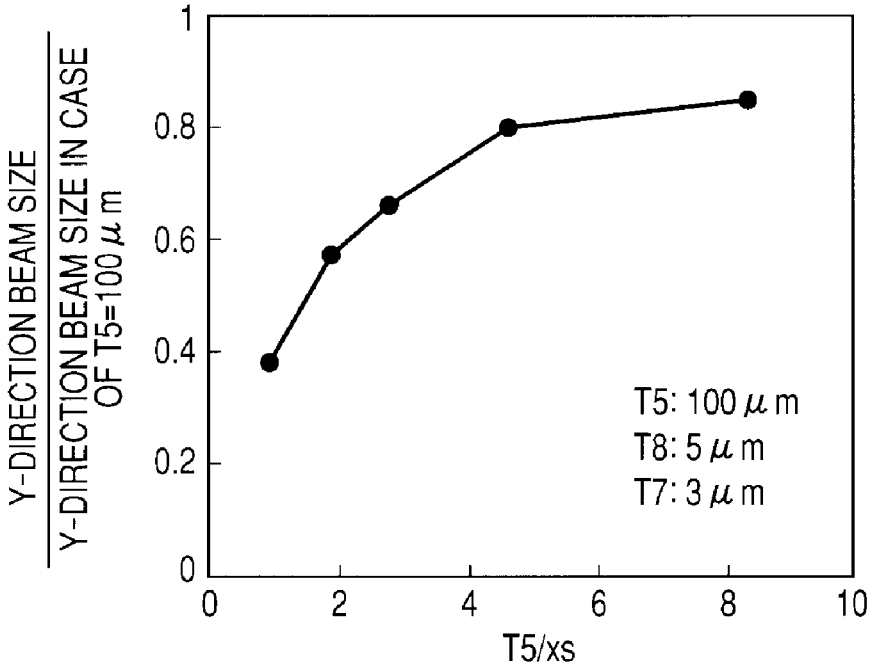
FIG. 33B is a graph showing the relationship of FIG. 33A, normalized to a case where T5=100 μm.

FIG. 33A shows the size of the electron beam in the Y-direction for three combinations of Va and Vf. However, as illustrated in FIG. 33B, the size of the electron beam in the Y-direction is characterized by one curve when normalized to a size in case of T5=100 μm. In the graphs, xs is expressed by an expression below.

$$xs=(Vc/Va)\times(h/\pi)$$

Here, π is a circular constant.

Third Embodiment

Next, description of an electron emitting device of an electron beam apparatus according to the third embodiment of the present invention will be provided with reference to FIGS. 34A to 34D.

Figure 34A:
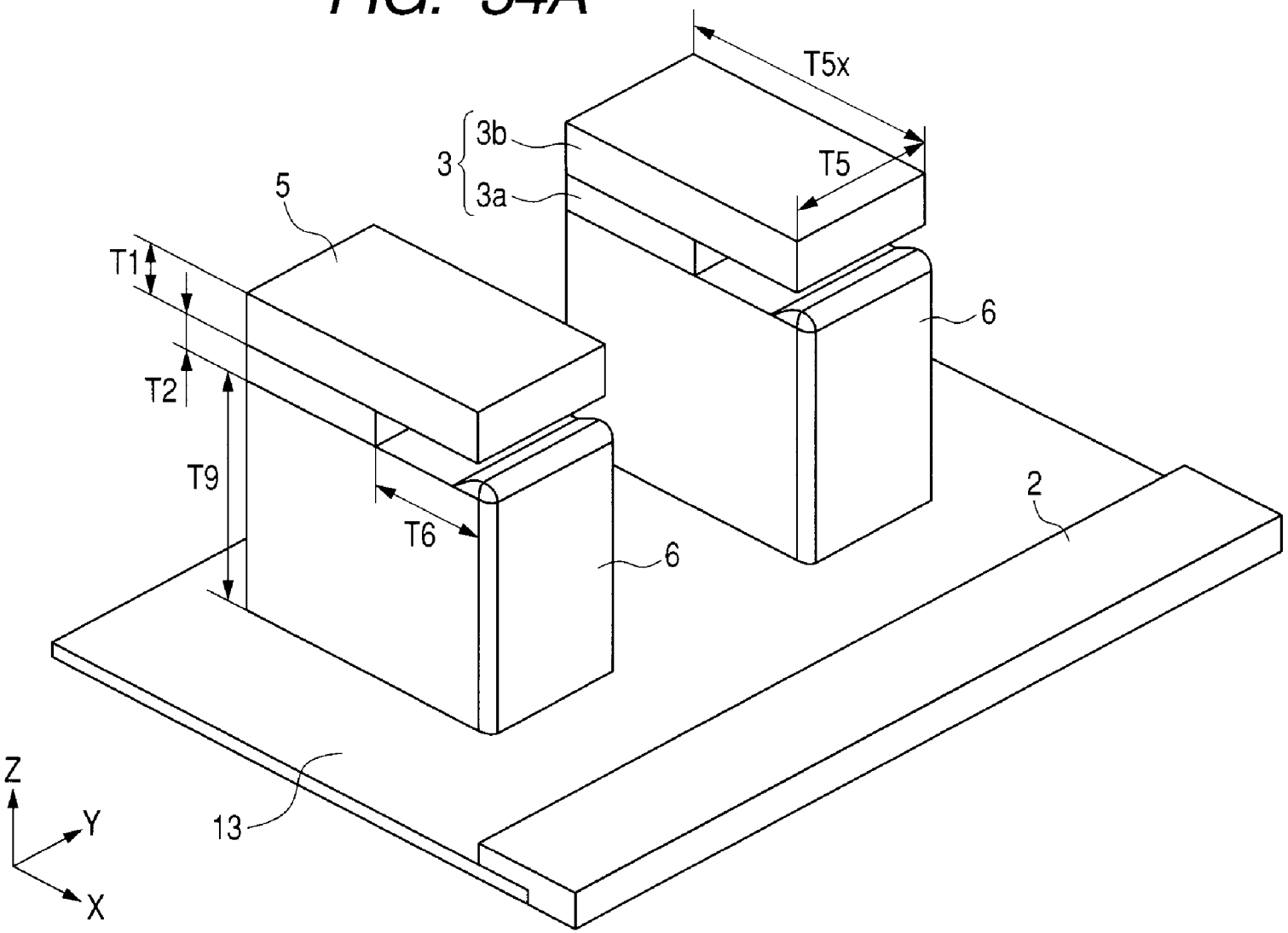
FIG. 34A is a perspective view schematically illustrating a configuration of an electron emitting device of an electron beam apparatus according to another embodiment of the present invention.
Figure 34B:
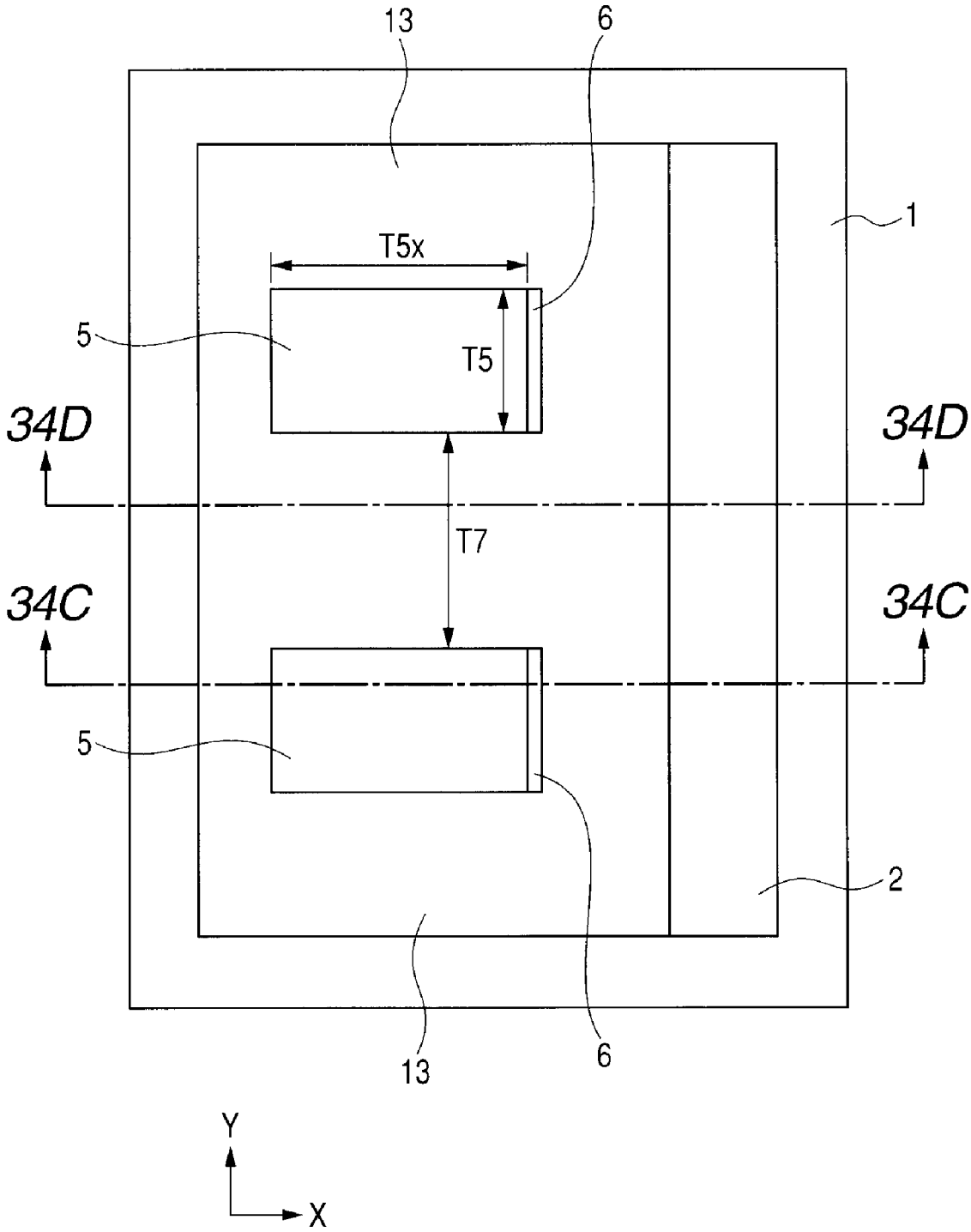
FIG. 34B is a schematic plane view of the electron emitting device illustrated in FIG. 34A.

The electron emitting device of the present embodiment has such a configuration that in the electron emitting device of the electron beam apparatus according to the second embodiment, the widths of the recessed portion 9 and the control electrode 13 formed in a region exposed to the recessed portion 9 are increased further so that the gate 5 is surrounded by the recessed portion 9 and the control electrode 13. That is to say, in the present embodiment, the gate 5 is formed rectangular, and the control electrode 13 is disposed around the gate 5, as illustrated in FIG. 34A.

In the present embodiment, the cathode 6 and the gate 5 opposed to the cathode 6 may be provided in one set, but they are preferably provided in two or more sets at a certain distance. FIG. 34A illustrates an example where the cathode 6 and the gate 5 are provided in two sets.

FIGS. 34A to 34D illustrate a configuration where an entire portion of the insulating member 3 exposed to the recessed portion 9 is removed, but the insulating layer 3*b* may be removed partly as illustrated in FIG. 1A. The effect of the recessed portion 9 and the control electrode 13 in this configuration is the same as that of the second embodiment. However, if it is assumed that a length of the gate 5 in a direction (X direction) perpendicular to an edge of the gate 5 opposed to the cathode 6 on a gate surface (XY plane) opposed to the anode 11 is T5*x* [m], then it is necessary to satisfy the following expressions.

$$T5<5\times(Vf/Va)\times(h/\pi)$$

$$T5x<5\times(Vf/Va)\times(h/\pi)$$

$$Vf\geqq Vc$$

Figure 34C:
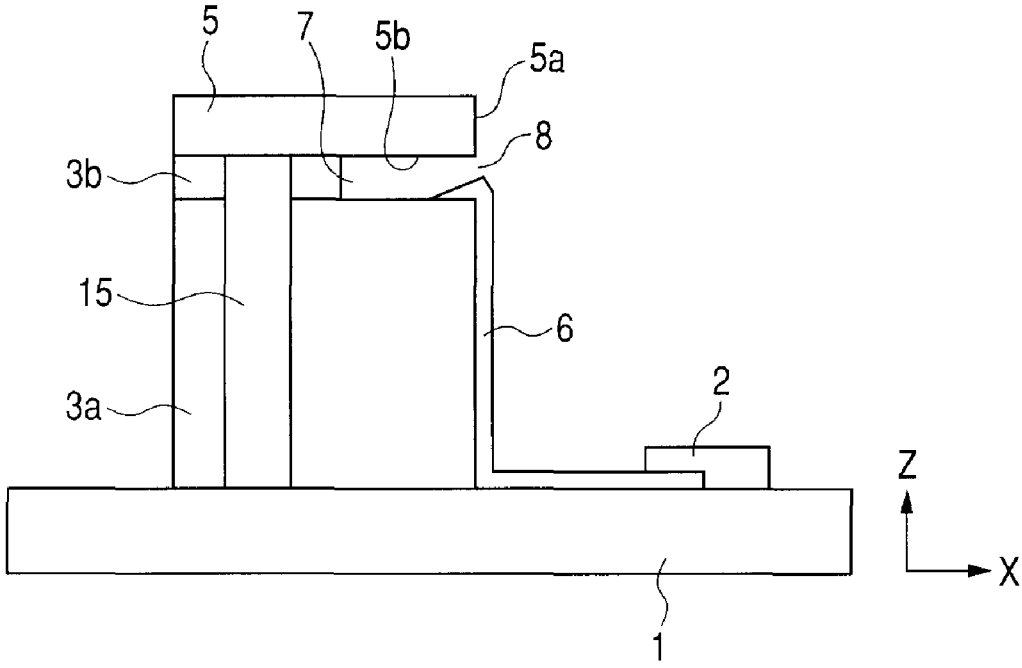
FIG. 34C is a schematic cross-sectional view of the electron emitting device taken along the line 34C-34C in FIG. 34B.
Figure 34D:
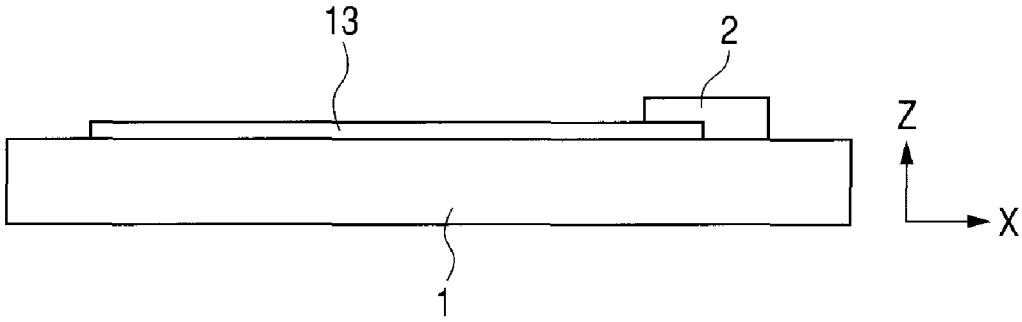
FIG. 34D is a schematic cross-sectional view of the electron emitting device taken along the line 34D-34D in FIG. 34B.

Since the gate 5 needs to be in an electrically isolated state from the control electrode 13 and the cathode 6, as illustrated in FIG. 34C, a contact hole is formed in the insulating member 3 and a conductive member 15 is filled therein so that a potential of the gate 5 can be extracted outside the device by wirings formed on the substrate 1 through the conductive member 15.

Manufacturing Method

Figure 8A:
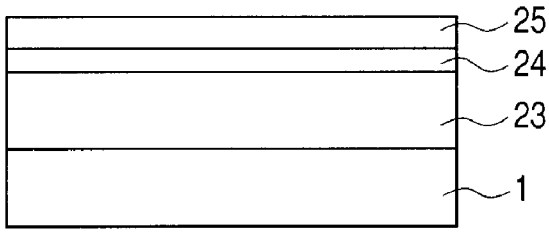
FIGS. 8A, 8B, 8C, 8D, 8E, 8F and 8G are diagrams illustrating the manufacturing processes of the electron emitting device according to the embodiment of the present invention.
Figure 8B:
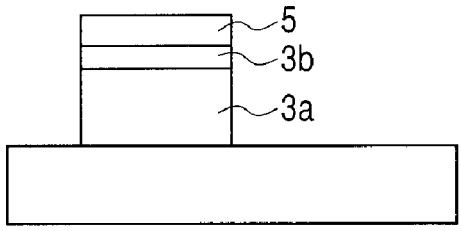

Description of a manufacturing method of the electron emitting device according to the embodiments of the present invention will be provided with reference to FIGS. 8A and 8B.

FIGS. 8A and 8B are schematic views illustrating a sequence of manufacturing processes of the electron emitting device illustrated in FIG. 1C.

The substrate 1 is an insulating substrate for mechanically supporting the device and may be quartz glass, glass with a reduced content of impurities such as Na, soda lime glass, and a silicon substrate, for example.

First, as illustrated in FIG. 8A, on the substrate 1, an insulating layer 23 serving as the insulating layer 3*a*, an insulating layer 24 serving as the insulating layer 3*b*, and a conductive layer 25 serving as the gate 5 are laminated. The insulating layers 23 and 24 are insulating films made from materials having excellent processability such as, SiN ($Si_xN_y$) or $SiO_2$, and can be formed by a general vacuum film formation method such as a sputtering method, a CVD method, a vacuum evaporation method, or the like. The thicknesses of the insulating layers 23 and 24 are set in a range of 5 nm to 50 μm, and are preferably selected in a range of 20 nm to 500 nm. In this case, since it is necessary to form the notch 7 after the insulating layers 23 and 24 are laminated, it should be made sure that the insulating layers 23 and 24 have different etching rates. A selection ratio of the insulating layer 23 to the insulating layer 24 is preferably set to 10 or more, and more preferably to 50 or more. Specifically, $Si_xN_y$ is used for the insulating layer 23, and insulating materials such as $SiO_2$ are used for the insulating layer 24, for example. Alternatively, the insulating layer 24 may be made from PSG having high phosphorus concentration, and BSG having high boron concentration, for example.

The conductive layer 25 is formed by a general vacuum film formation technique such as an evaporation method or a sputtering method. The conductive layer 25 is preferably formed from materials having electrical conductivity, high thermal conductivity, and high melting points.

The thickness of the conductive layer 25 is set in a range of 5 nm to 500 nm, and is preferably selected in a range of 20 nm to 500 nm.

Subsequently, a resist pattern is formed on the conductive layer 25 by a photolithography technique, and thereafter, the conductive layer 25, the insulating layer 24, and the insulating layer 23 are sequentially processed using an etching method. In this way, as illustrated in FIG. 8B, the gate 5 and the insulating member 3 composed of the insulating layer 3*b* and the insulating layer 3*a* are obtained.

Figure 8C:
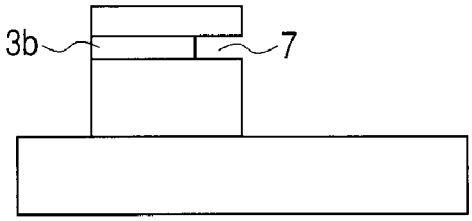

Subsequently, only a side surface of the insulating layer 3*b* in one side surface of the laminated structure is partly removed using an etching method, thus forming the notch 7 as illustrated in FIG. 8C.

The etching method may use a mixed solution of ammonium fluoride and hydrofluoric acid, which is typically called buffered hydrofluoric acid (BHF), if the insulating layer 3*b* is formed from $SiO_2$, for example. Moreover, if the insulating layer 3*b* is formed from $Si_xN_y$, the etching method may use a hot phosphoric acid-based etching solution.

The depth of the notch 7, that is, a distance (T6 in FIG. 1A) between a side surface of the insulating layer 3*b* in the notch 7 and the side surfaces of the insulating layer 3*a* and the gate 5 is strongly correlated with a leak current which may occur after the device is formed. The deeper the depth of the notch 7, the smaller is the leak current. However, since an extremely deep notch 7 may introduce a problem such as deformation of the gate 5, the notch 7 is formed to a depth of around 30 nm to 200 nm.

Although the present embodiment illustrates the insulating member 3 as a laminated structure of the insulating layers 3*a* and 3*b*, the present invention is not limited to this and the notch 7 may be formed by further removing a part of the insulating layer.

Subsequently, a resist pattern is formed on the gate 5 in order to form the recessed portion 9. Specifically, the gate 5 and the insulating layer 3*b*, and if necessary, the insulating layer 3*a* are sequentially processed using an etching method, thus forming the recessed portion 9 in the gate 5, and an unnecessary portion of the insulating member 3 is removed.

Figure 8D:
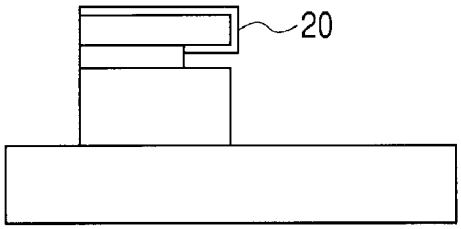

Subsequently, a delamination layer 20 is formed on the surface of the gate 5 as illustrated in FIG. 8D. The object of forming the delamination layer 20 is to delaminate a cathode material 26, which is deposited in a later process, from the gate 5. For this reason, the delamination layer 20 is formed by a method of oxidizing the gate 5 to form an oxide film thereon or depositing a delamination metal thereto by electroplating, for example.

Here, in the second and third embodiments, a constituent material film for the control electrode 13 is formed on the surface of the insulating layer 3 exposed to the recessed portion 9, and the surface is subjected to patterning. The thickness of the control electrode 13 is set in a range of 5 nm to 500 nm, and is preferably selected in a range of 20 nm to 500 nm.

Figure 8E:
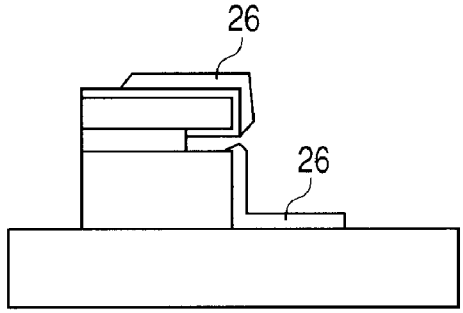

Thereafter, as illustrated in FIG. 8E, a cathode material 26 is deposited to the substrate 1 and the side surface of the insulating member 3. At this time, the cathode material 26 is also deposited to the gate 5.

As the material for the cathode, materials having electrical conductivity and capable of emitting electrons are used. Such materials typically have a high melting point of 2000° C. or higher and a work function of 5 eV or lower. Preferred materials are those which rarely form a chemical reaction layer such as an oxide layer or which form a reaction layer that can be removed by a simple and easy method.

As a deposition method of the cathode material 26, a general vacuum film formation technique such as an evaporation method or a sputtering method is used, and an EB evaporation method is preferred.

As described above, in the present invention, for the electrons to be extracted efficiently, it is necessary to control an angle and a film forming time during the evaporation, and the temperature and degree of vacuum when forming the cathode 6 so that the cathode 6 is produced to have an optimal shape.

Figure 8F:
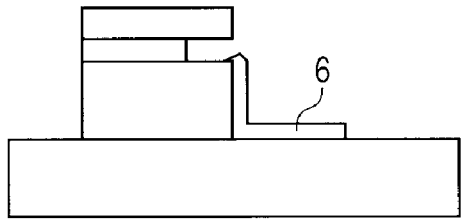

Subsequently, as illustrated in FIG. 8F, the delamination layer 20 is etched out to remove the cathode material 26 on the gate 5. Moreover, the cathode material on the substrate 1 and the side surface of the insulating member 3 is patterned by photolithography or the like, thus forming the cathode 6.

Figure 8G:
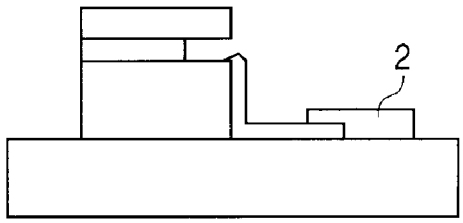

Subsequently, as illustrated in FIG. 8G, an electrode 2 is formed so as to achieve electrical conduction with the cathode 6. The electrode 2 has electrical conductivity similar to the cathode 6 and is formed by a general vacuum film formation technique such as an evaporation method or a sputtering method and a photolithography technique.

The thickness of the electrode 2 is set in a range of 50 nm to 5 mm, and is preferably selected in a range of 50 nm to 5 μm.

Although the electrode 2 and the gate 5 may be formed of the same materials or different materials and by the same forming method or different forming methods, the gate 5 usually has a thickness smaller than that of the electrode 2, and thus a low resistance material is preferably used for the gate 5.

Figure 25A:
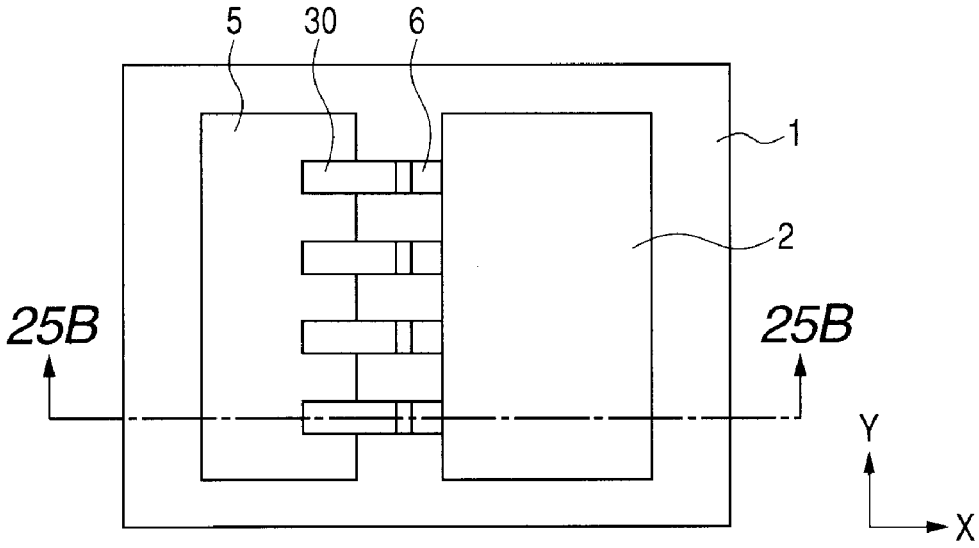
FIGS. 25A, 25B and 25C are schematic views illustrating another exemplary configuration of the electron emitting device of the electron beam apparatus according to the embodiment of the present invention.
Figure 25B:
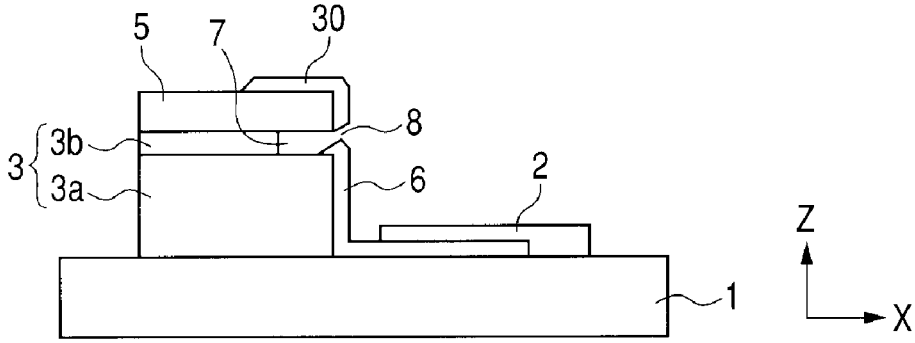
Figure 25C:
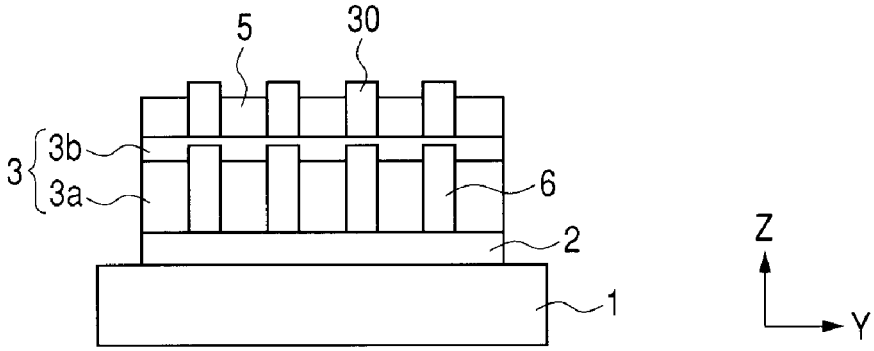

Although in the manufacturing method described above, the cathode material 26 on the gate 5 is removed by means of the delamination layer 20, the scope of the present invention also includes a configuration as illustrated in FIGS. 25A to 25C in which a protruding portion 30 formed of the cathode material 26 is formed on the gate 5. Such a protruding portion 30 may be formed by a method of depositing the cathode material 26 on the gate 5 without providing the delamination layer 20 on a region of the gate 5 corresponding to the cathode 6, or a method of depositing the cathode material 26 without providing the delamination layer 20 and then patterning the cathode material 26.

Figure 26:
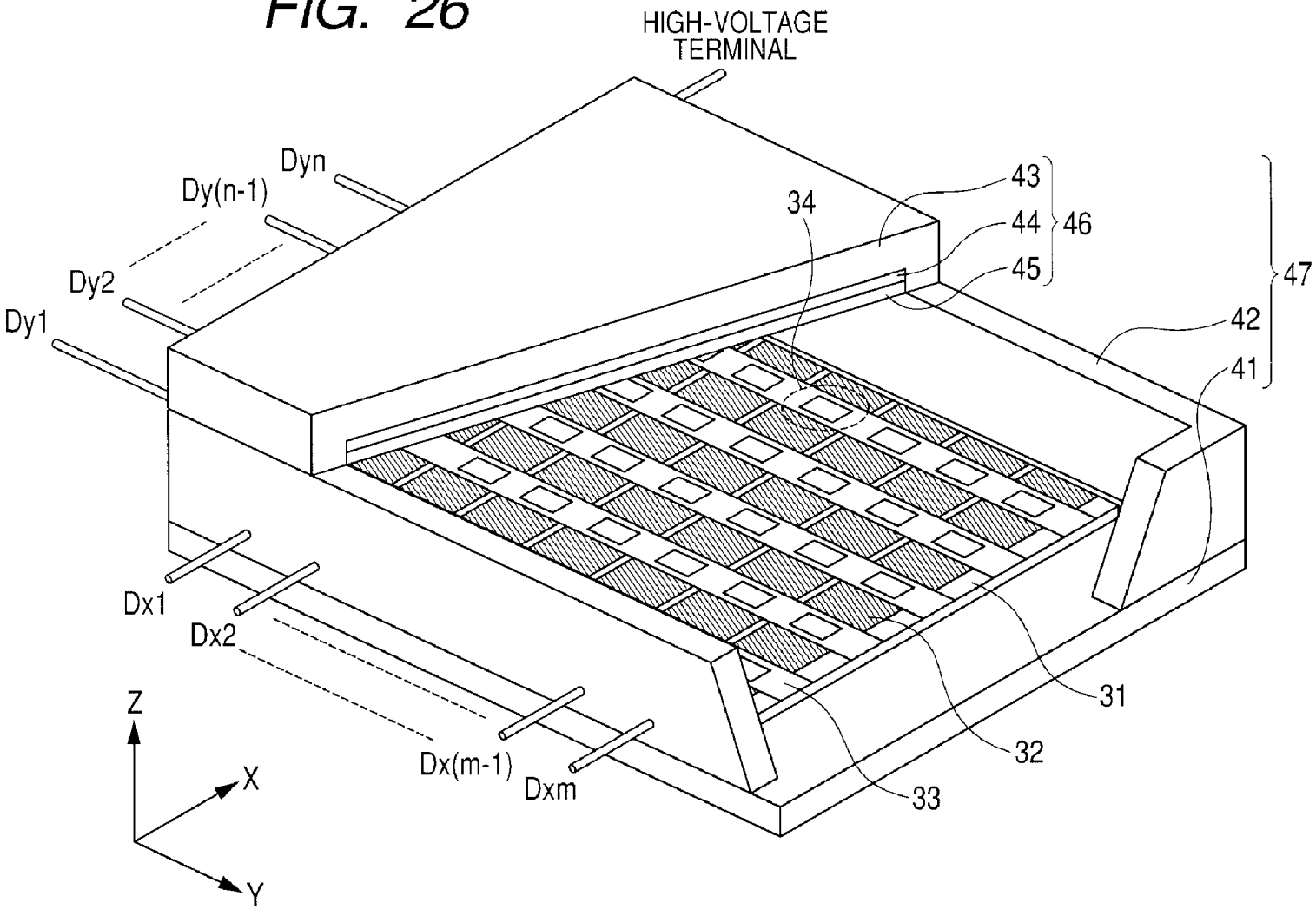
FIG. 26 is a perspective view schematically illustrating a configuration of a display panel which is an example of an image displaying apparatus according to an embodiment of the present invention.

Next, description of an image displaying apparatus provided with an electron source which is obtained by arranging a plurality of electron emitting devices according to the embodiment of the present invention will be provided with reference to FIG. 26. FIG. 26 is a schematic view, partly cut out, illustrating an example of a display panel of an image displaying apparatus.

Referring to FIG. 26, the display panel includes an electron source substrate 31 which is fixed to a rear plate 41, and a face plate 46 in which a fluorescent film 44, which is a layer of phosphors serving as light-emitting members, a metal back 45, which is the anode 11, and the like are formed on an inner surface of a glass substrate 43.

The display panel further includes a support frame 42 to which the rear plate 41 and the face plate 46 are bonded using frit glass or the like, thus forming an envelope 47. The bonding using frit glass is carried out by baking them in air or a nitrogen atmosphere at a high temperature range of 400 to 500° C. for 10 minutes or longer.

As described above, the envelope 47 is constructed by the face plate 46, the support frame 42, and the rear plate 41. The rear plate 41 is provided mainly for a purpose of reinforcing the strength of the electron source substrate 31. Thus, when the electron source substrate 31 itself has a sufficient strength, the additional rear plate 41 may be omitted.

That is to say, the support frame 42 may be directly bonded to the electron source substrate 31, and the envelope 47 may be constructed by the face plate 46, the support frame 42, and the electron source substrate 31. On the other hand, a support, which is not illustrated and is called a spacer, may be provided between the face plate 46 and the rear plate 41 so that the envelope 47 has a sufficient strength against air pressure.

In such an image displaying apparatus, the phosphors are aligned over each electron emitting device 34 in consideration of the trajectories of emitted electrons.

The envelope 47 serving as the display panel is connected to the external electric circuits through terminals Dx1 to Dxm, terminals Dy1 to Dyn, and a high-voltage terminal. The terminals Dx1 to Dxm are connected to X-directional wires 32 and are supplied with scan signals for successively driving the electron source disposed inside the display panel, i.e., the electron emitting device group having a matrix wire configuration of m rows by n columns on a row by row basis (N devices at a time). On the other hand, the terminals Dy1 to Dyn are connected to Y-directional wires 33 and are supplied with modulation signals for controlling output electron beams of the respective electron emitting devices of one row selected by the scan signals.

A DC voltage of 10 [kV], for example, is supplied from a DC voltage source Va to the high-voltage terminal, and this voltage is an acceleration voltage for imparting sufficient energy for exciting the phosphors to the electron beams emitted from the electron emitting devices.

As described above, by the application of the scan signals, the modulation signals, and the high voltage to the anode, the emitted electrons are accelerated to be irradiated to the phosphors, whereby images are displayed.

When the image displaying apparatus is formed using the electron emitting device according to the embodiment of the present invention, it is possible to obtain an image displaying apparatus in which the electron beam shapes are neatly arranged. Thus, it is possible to provide an image displaying apparatus having good display quality.

EXAMPLES

Example 1

An electron emitting device having the configuration illustrated in FIGS. 1A to 1D was produced by the processes illustrated in FIGS. 8A to 8G.

First, a PD 200 which is a low sodium glass developed for use in plasma displays was used as the substrate 1, and the insulating layers 23 and 24 were formed by a sputtering method using SiN ($Si_xN_y$) having a thickness of 500 nm and $SiO_2$ having a thickness of 30 nm, respectively. Subsequently, the conductive layer 25 was laminated by a sputtering method using TaN having a thickness of 30 nm (see FIG. 8A).

Subsequently, a resist pattern including the projected region 12 having a comb teeth-like shape and the recessed portion 9 was formed on the conductive layer 25 by a photolithography technique, and thereafter, the conductive layer 25, the insulating layer 24, and the insulating layer 23 were sequentially processed using a dry etching method. At this time, the comb teeth-like shape was processed at a pitch of 10 μm so that the recess distance T8 was 100 nm, and the distance T7 between the cathodes 6, the width T4 of the cathode 6, and the width T5 of the projected region 12 were 5 μm (see FIG. 8B).

Moreover, $CF_4$-based gas was used as a processing gas because materials that form hydrofluoric acid were selected as the materials for the insulating layers 23 and 24 and the conductive layer 25. The result of RIE using this gas was that the etched side surfaces of the insulating layers 3*a* and 3*b* and the gate 5 were at an angle of about 80° relative to the horizontal plane of the substrate 1.

After the resist was delaminated, the side surface of the insulating layer 3*b* was etched by an etching method using BHF (which is a solution of ammonium fluoride and hydrofluoric acid) so that the depth T6 was about 70 nm, whereby the notch 7 was formed in the insulating member 3 (see FIG. 8C).

Then, Ni was electrolytically precipitated on the surface of the gate 5 by electroplating, and the delamination layer 20 was formed (see FIG. 8D).

Subsequently, molybdenum (Mo) used as the cathode material 26 was deposited to the upper surface of the gate 5, the side surface of the insulating member 3, and the surface of the substrate 1. In this example, an EB evaporation method was used as the film formation method. In this formation method, an inclination of the substrate 1 was set to 60° relative to the horizontal plane. In this way, Mo was incident on the gate 5 at an incidence angle of 60° and on the RIE-processed sloped surface of the insulating member 3 at an incidence angle of 40°. The evaporation was performed at a constant evaporation speed of about 12 nm/min while precisely controlling an evaporation period to be 2.5 minutes, whereby a Mo film was formed to a thickness of 30 nm on the sloped surface (see FIG. 8E).

After the Mo film was formed, the Ni delamination layer 20 precipitated on the gate 5 was removed using an etching solution composed of iodine and potassium iodide, whereby the Mo film on the gate 5 was delaminated (see FIG. 8F).

Subsequently, a resist pattern was formed by a photolithography technique so that the width T4 of the cathode 6 was 5 μm. Thereafter, the Mo film on the substrate 1 and the side surface of the insulating layer 3*a* was processed using a dry etching method, and the cathode 6 was formed. Moreover, $CF_4$-based gas was used as a processing gas because when molybdenum is used as the cathode material 26, it forms fluorides.

The result of cross-sectional TEM (transmission electron microscopy)-based analysis was that the shortest distance T13 of the gap 8 between the cathode 6 and the gate 5 was 9 nm.

Subsequently, Cu was deposited to a thickness of 500 nm by a sputtering method and patterned, whereby the electrode 2 was formed (see FIG. 8G).

The electron emitting device was formed by the above-described method, and the characteristics of the electron emitting device were evaluated using an arrangement illustrated in FIG. 9.

FIG. 9 illustrates a power supply arrangement used for measuring the electron emission characteristics of the device according to the embodiment of the present invention. As illustrated in FIG. 9, in the electron beam apparatus of the present invention, the anode 11 is disposed to be opposed to the protruding portion of the cathode 6 via the gate 5. In this example, since the insulating member 3 is disposed on the substrate 1, it can be said that the anode 11 is disposed to be opposed to the substrate 1 on a side of the substrate 1 where the insulating member 3 is disposed.

Referring to FIG. 9, Vf is a voltage applied between the gate 5 of the device and the cathode 6, If is a current flowing at that time, Va is a voltage applied between the cathode 6 and the anode 11, and Ie is an electron emission current.

Here, the electron emission efficiency η is typically given by an expression, $\eta = Ie/(If+Ie)$, using the current If detected upon application of a voltage to the device and the current Ie extracted into a vacuum.

The characteristics of the device of this example were evaluated using the arrangement of FIG. 9, and the evaluation result showed that the electron emission current Ie was 1.5 μA at the driving voltage of 26 V and the electron emission efficiency was 14% on average.

Comparative Example 1

Next, an electron emitting device was produced in the same manner as Example 1, except that the recessed portion 9 was not provided to the gate 5, and a region of the insulating member 3 corresponding to the recessed portion 9 was not removed. The cathode 6 was formed like stripes similarly to Example 1.

The same characteristic evaluation as Example 1 was conducted on the electron emitting device obtained thus, and the evaluation result showed that the electron emission current Ie was around 0.8 μA at the driving voltage of 26 V, and the electron emission efficiency was around 9% on average.

Example 2

An electron emitting device was produced in the same manner as Example 1 except that T8 was changed, and the dependence of the electron emission efficiency on T8 was observed.

Figure 10:
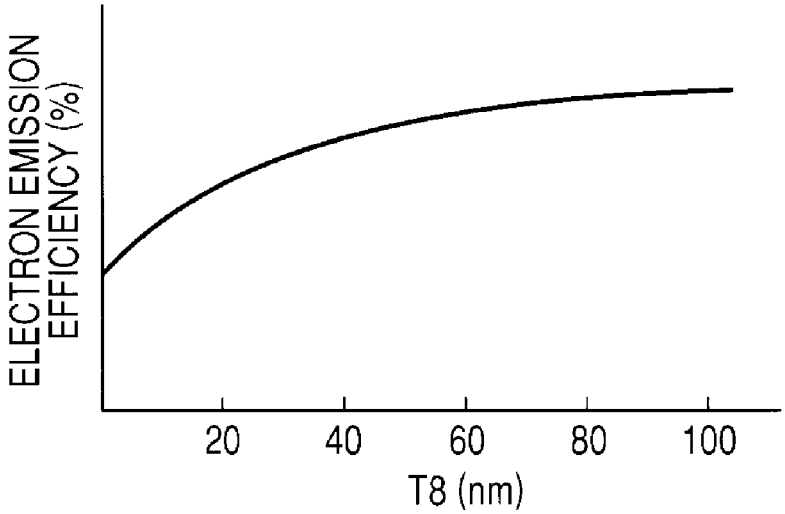
FIG. 10 is a graph showing the relationship between a recess distance T8 and electron emission efficiency, according to Example of the present invention.

The observation result showed that the electron emission efficiency increased as T8 was increased, however, the influence of increased T8 became weak gradually, showing a tendency to reach its saturation point at a certain value. The result is graphically shown in FIG. 10.

The electron emission efficiency in case of T8=0 was about 8% and showed a gradual increase as T8 was increased to 20 nm, 40 nm, 60 nm, and so on, reaching around 14% at T8=80 nm; however, the efficiency did not show any further increase even when T8 was increased further.

Figure 11:
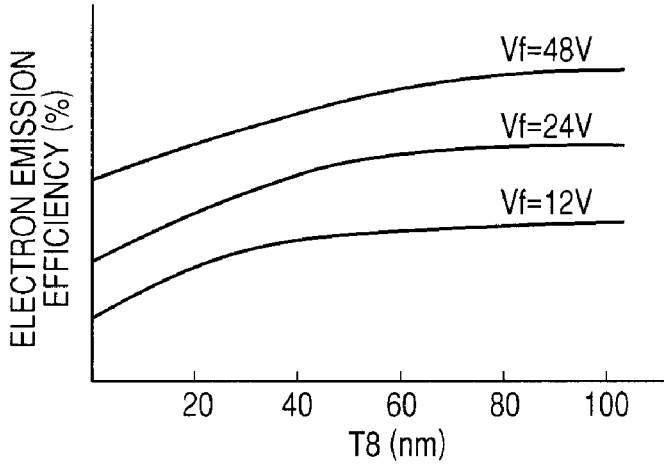
FIG. 11 is a graph showing the relationship for each driving voltage Vf between a recess distance T8 and electron emission efficiency, according to Example of the present invention.

Subsequently, the dependence on the driving voltage of the electron emitting device at the same T8 was observed. As illustrated in FIG. 11, the observation result showed that the lower the driving voltage, lower electron emission efficiency was obtained; however, the electron emission efficiency reached its saturation point at a lower value of T8. On the other hand, the higher the driving voltage, higher electron emission efficiency was obtained; however, the electron emission efficiency reached its saturation point at a higher value of T8.

Simulation-Based Examination

The results obtained with Examples 1 and 2 and Comparative Example were calculated by simulation so as to confirm the effects of the present invention.

In the calculations below, the following numeric values were used unless specified otherwise: T1=30 nm, T2=30 nm, T3=500 nm, T4=T5=5 μm, T6=70 nm, and T7=3 μm. Moreover, the following values were used: the driving voltage Vf=24 V, the anode-application voltage Va=11.8 kV, and the work function Wf=4.6 eV.

Case Where T8 was Changed

The calculation results when T8 was changed in a range of 0 nm to 120 nm are graphically shown in FIG. 4.

It can be seen from FIG. 4 that the electron emission efficiency increased gradually as the recess distance T8 was increased; however, the electron emission efficiency became substantially constant at certain higher values. If it is assumed that the recess distance T8 at which the efficiency becomes substantially constant is Lsat, the Lsat was about 65 nm as can be seen from FIG. 4.

In the calculation results shown in FIG. 4, the number of electrons arriving at the anode for each time of electron scattering is summarized in Table 1.

TABLE 1

| T8 (nm) | Field Intensity (V/m) | Electron Emission Efficiency (%) | No Scattering | 1st Scattering | 2nd Scattering | 3rd Scattering | 4th Scattering | 5th Scattering | 6th Scattering | Total Numbers |
|---|---|---|---|---|---|---|---|---|---|---|
| 0 | $4.42\ 10^9$ | 9.36 | 156 | 11707 | 9316 | 5334 | 3200 | 2057 | 1362 | 50000 |
| 15 | $4.44\ 10^9$ | 10.4 | 69 | 13387 | 10001 | 5862 | 3410 | 2118 | 1477 | 50000 |
| 35 | $4.37\ 10^9$ | 12.4 | 34 | 17040 | 9629 | 5678 | 3474 | 2222 | 1486 | 50000 |
| 50 | $4.39\ 10^9$ | 13.2 | 12 | 18678 | 9166 | 5449 | 3445 | 2242 | 1558 | 50000 |
| 65 | $4.40\ 10^9$ | 13.8 | 28 | 19603 | 9216 | 5466 | 3485 | 2247 | 1612 | 50000 |
| 90 | $4.38\ 10^9$ | 13.9 | 9 | 19569 | 9683 | 5560 | 3406 | 2203 | 1604 | 50000 |
| 115 | $4.41\ 10^9$ | 13.9 | 7 | 19439 | 10122 | 5602 | 3424 | 2140 | 1468 | 50000 |

It can be seen from Table 1 that since the number of electrons arriving at the anode after the first scattering increases when the recess distance T8 is increased; an increased number of the first scattering electrons contributes to an increase in the efficiency. That is to say, it can be confirmed that, after they have collided with the gate 5 once, most of the electrons emitted from the cathode 6 arrive at the anode through the recessed portion 9 without making any further collision.

From the above, it can be concluded that the electron emission efficiency has increased when the recessed portion 9 was provided to the gate 5.

Subsequently, an examination was conducted as to how the value of the minimum recess distance Lsat, where the increase of the electron emission efficiency is saturated, will change when the shape of the gap 8 between the cathode 6 and the gate 5 through which electrons are emitted, the driving voltage, and the material of the cathode 6 were changed. Specifically, an examination was conducted by simulation as to how the value of Lsat will change when the values of T1, T2, T3, T4, and T5, the driving voltage Vf, the work function Wf of the cathode 6, the anode-application voltage Va were changed independently.

Relationship Between T8 and Vf

Figure 12:
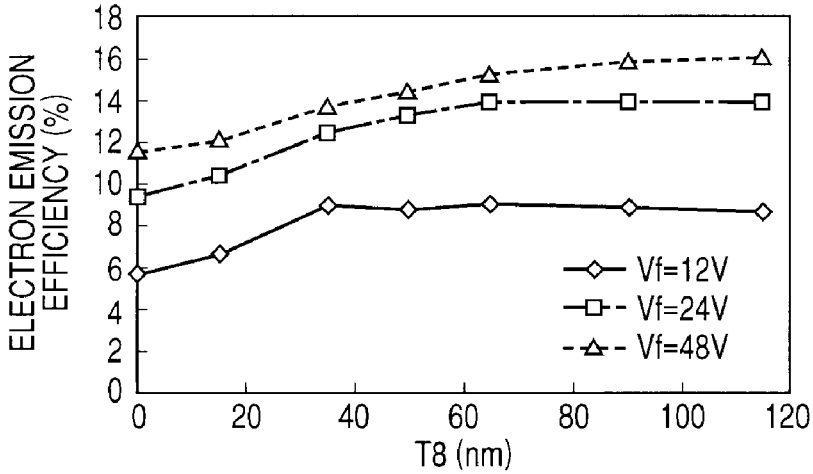
FIG. 12 is a graph showing the relationship for each driving voltage Vf between a recess distance T8 and electron emission efficiency, which is obtained by simulation.

The calculation results when the driving voltage Vf was changed in a range of 12 V to 48 V are graphically shown in FIG. 12. In FIG. 12, the horizontal axis represents the recess distance T8 and the vertical axis represents the electron emission efficiency. It can be seen from FIG. 12 that the recess distance Lsat at which the electron emission efficiency becomes constant differs depending on the value of the driving voltage Vf. The Lsat was 40 nm for Vf=12 V, 65 nm for Vf=24 V, and 100 nm for Vf=48 V as can be seen from FIG. 12.

Relationship Between T8 and T2

Figure 13:
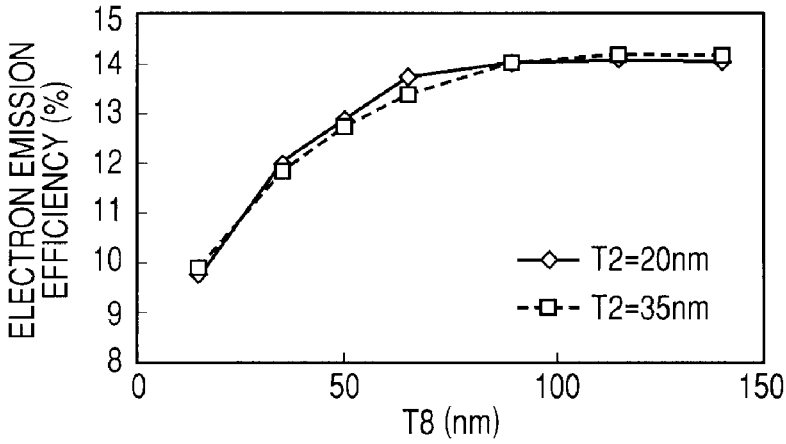
FIG. 13 is a graph showing the relationship for each notch height T2 between a recess distance T8 and electron emission efficiency, which is obtained by simulation.

The calculation results when the height T2 of the notch 7 was changed in a range of 20 nm to 35 nm are graphically shown in FIG. 13. In FIG. 13, the horizontal axis represents the recess distance T8 and the vertical axis represents the electron emission efficiency. It can be seen from FIG. 13 that the recess distance Lsat at which the electron emission efficiency becomes constant differs depending on the value of the height T2 of the notch 7. The Lsat was 90 nm for T2=20 nm and 120 nm for T2=35 nm as can be seen from FIG. 13.

Relationship Between T8 and Wf

Figure 14:
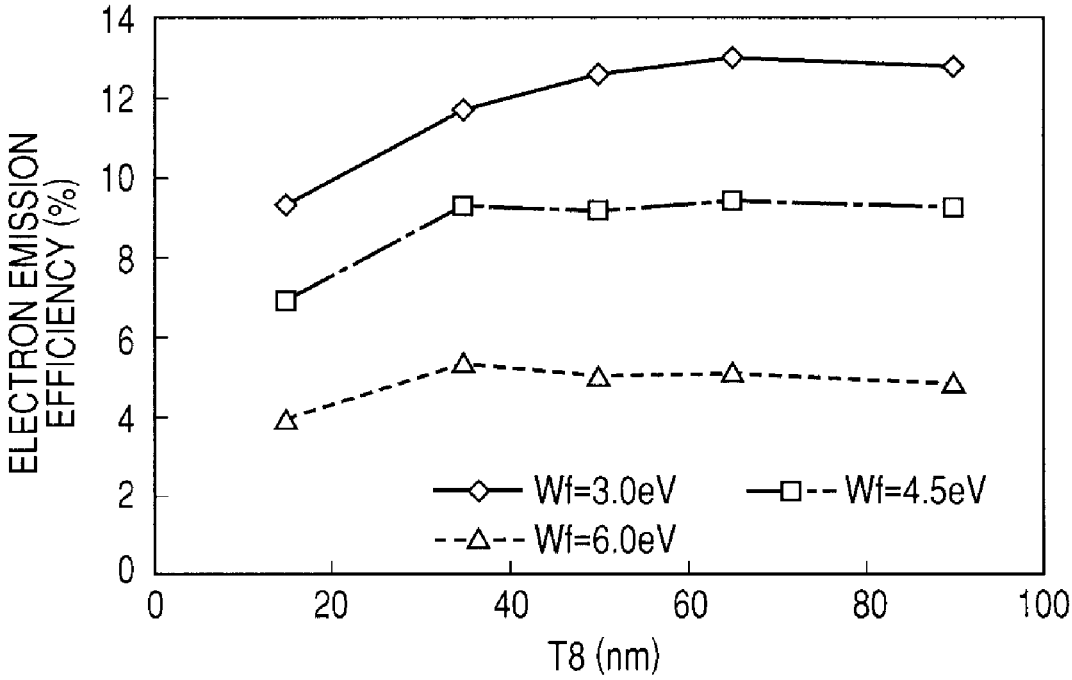
FIG. 14 is a graph showing the relationship for each work function Wf of the cathode between a recess distance T8 and electron emission efficiency, which is obtained by simulation.

The calculation results when the work function Wf of the constituent material of the cathode 6 was changed in a range of 3.0 eV to 6.0 eV are graphically shown in FIG. 14. In FIG. 14, the horizontal axis represents the recess distance T8 and the vertical axis represents the electron emission efficiency. In the calculation results shown in FIG. 14, the driving voltage Vf was set to 12 V. It can be seen from FIG. 14 that the recess distance Lsat at which the electron emission efficiency becomes constant differs depending on the value of the work function Wf. The Lsat was 70 nm for Wf=3.0 eV, 50 nm for Wf=4.5 eV, and 30 nm for Wf=6.0 eV as can be seen from FIG. 14.

Relationship Between T8 and T1

Figure 15:
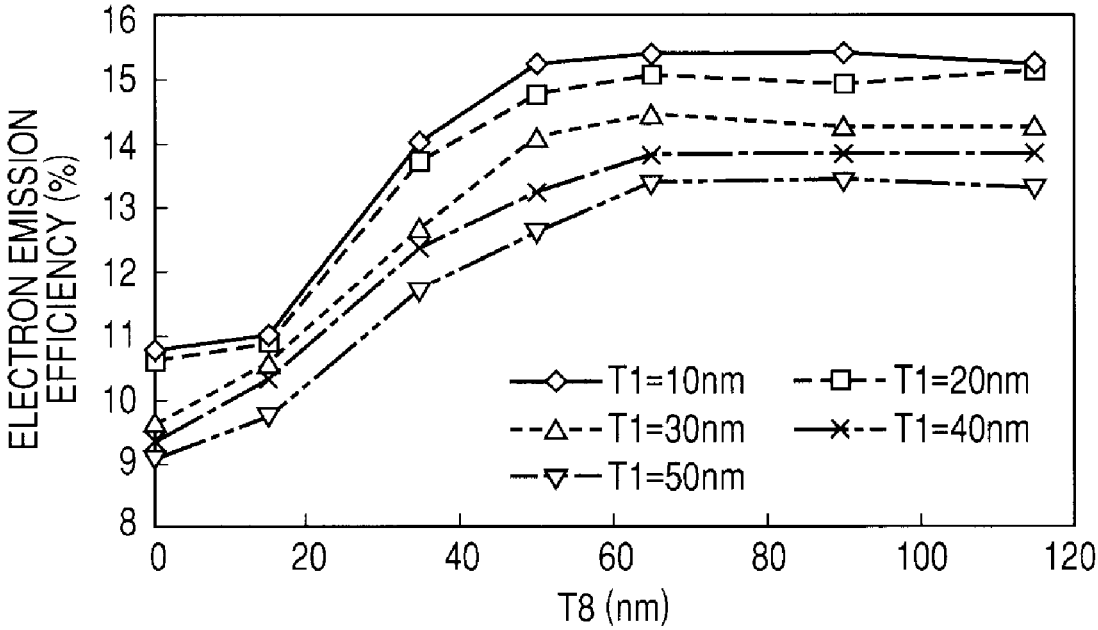
FIG. 15 is a graph showing the relationship for each gate height T1 between a recess distance T8 and electron emission efficiency, which is obtained by simulation.

The calculation results when the height T1 of the gate 5 was changed in a range of 10 nm to 50 nm are graphically shown in FIG. 15. In FIG. 15, the horizontal axis represents the recess distance T8 and the vertical axis represents the electron emission efficiency. It can be seen from FIG. 15 that the recess distance Lsat at which the electron emission efficiency becomes constant did not changed much depending on the value of the height T1 of the gate 5.

Relationship Between T8 and T3

Figure 16:
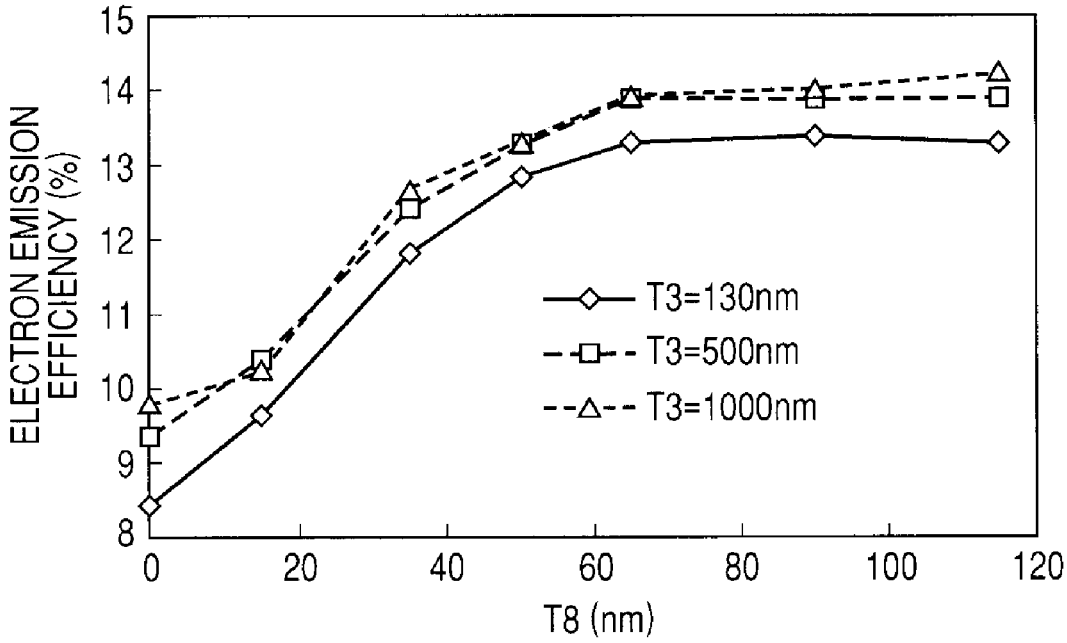
FIG. 16 is a graph showing the relationship for each height T3 of an insulating layer between a recess distance T8 and electron emission efficiency, which is obtained by simulation.

The calculation results when the distance T3 between the notch 7 and the substrate 1 (i.e., the height of the insulating layer 3*a*) was changed in a range of 130 nm to 1 μm are graphically shown in FIG. 16. In FIG. 16, the horizontal axis represents the recess distance T8 and the vertical axis represents the electron emission efficiency. It can be seen from FIG. 16 that the recess distance Lsat at which the electron emission efficiency becomes constant did not changed much depending on the distance T3 between the notch 7 and the substrate 1.

Relationship Between T8 and T7

Figure 17:
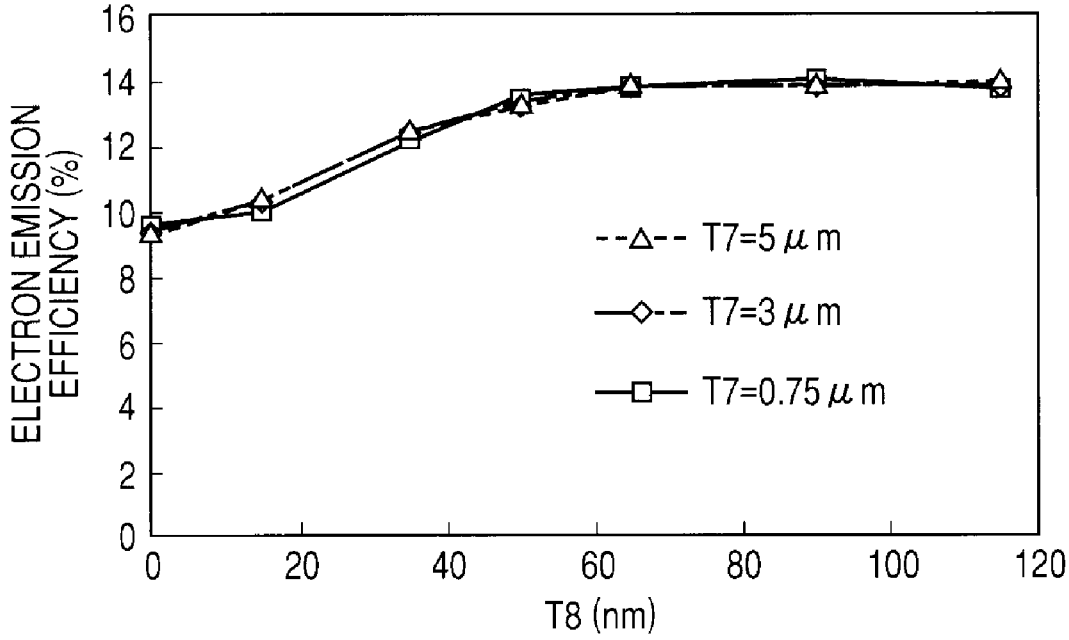
FIG. 17 is a graph showing the relationship for each inter-cathode distance T7 between a recess distance T8 and electron emission efficiency, which is obtained by simulation.

The calculation results when the distance T7 between the cathodes 6 was changed in a range of 750 nm to 5 μm are graphically shown in FIG. 17. In FIG. 17, the horizontal axis represents the recess distance T8 and the vertical axis represents the electron emission efficiency. It can be seen from FIG. 17 that the recess distance Lsat at which the electron emission efficiency becomes constant did not changed much depending on the value of T7.

Relationship Between T8 and Va

Figure 18:
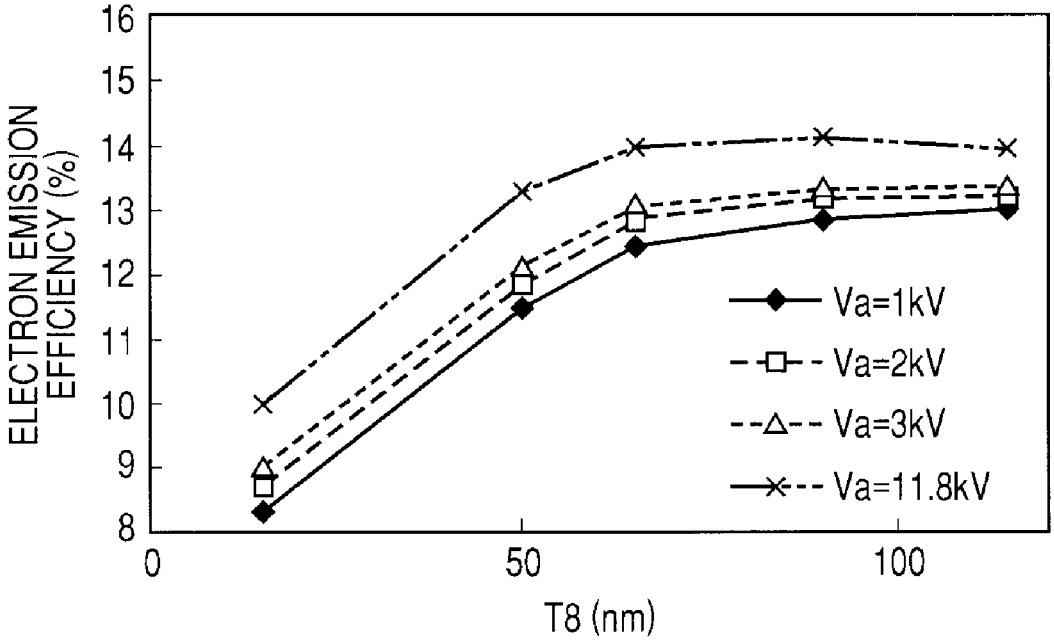
FIG. 18 is a graph showing the relationship for each anode-application voltage Va between a recess distance T8 and electron emission efficiency, which is obtained by simulation.

The calculation results when the anode-application voltage Va was changed in a range of 1 kV to 11.8 kV are graphically shown in FIG. 18. In FIG. 18, the horizontal axis represents the recess distance T8 and the vertical axis represents the electron emission efficiency. It can be seen from FIG. 18 that the recess distance Lsat at which the electron emission efficiency becomes constant did not changed much depending on the value of the anode-application voltage Va.

Relationship Between T4 and T5

The calculation results have been discussed for the case where the width T4 of the cathode 6 is the same as the width T5 of the projected region of the gate 5 opposed to the cathode 6, namely, the case of T12=0 in FIG. 6. In the case of T4≧T5, it can be said from the foregoing results that the provision of the recessed portion 9 has an effect of increasing the electron emission efficiency. An examination will be conducted on the case of T5>T4, namely, T12>0.

Figure 19:
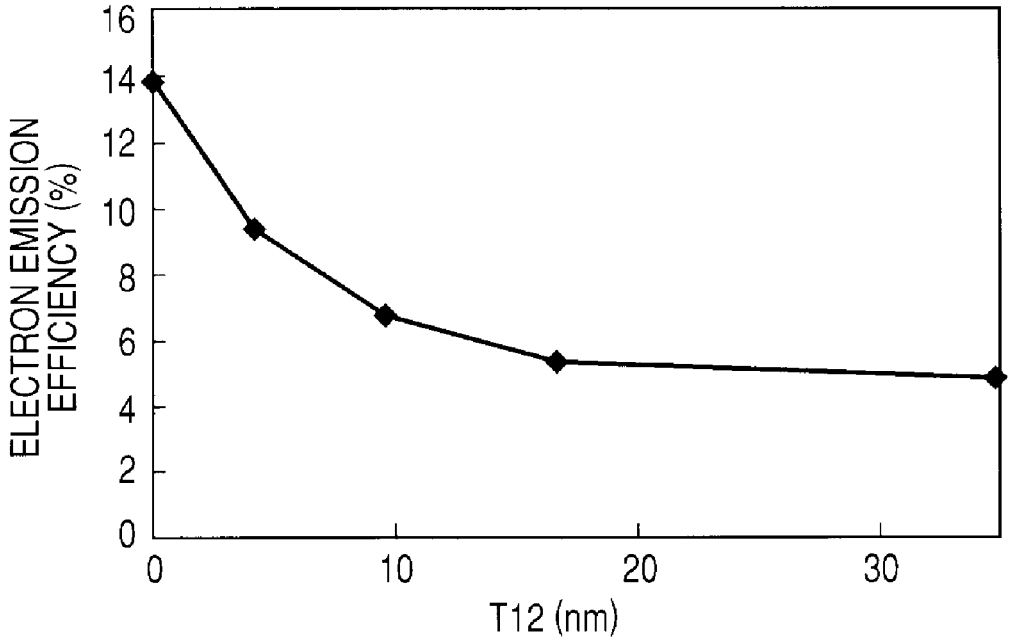
FIG. 19 is a graph showing the relationship between a length T12 of a portion where a projected region of a gate protrudes from a region opposed to a cathode and electron emission efficiency, which is obtained by simulation.

The calculation results when the recess distance T8 was 115 nm, the shortest distance T13 between the cathode 6 and the gate 5 was 12 nm, and the value of T12 was changed in a range of 0 nm to 35 nm are graphically shown in FIG. 19. In FIG. 19, the horizontal axis represents T12 and the vertical axis represents the electron emission efficiency. It can be seen from FIG. 19 that the electron emission efficiency decreased as the value of T12 was increased. Therefore, it can be concluded that it is preferable to satisfy an expression T12<T13 in order to obtain the effect of increasing the electron emission efficiency from the provision of the recessed portion 9.

Examination on Configurations of FIG. 2A and FIG. 20

The calculation results have been discussed for the configuration illustrated in FIG. 2A where the side surface of the insulating member 3 corresponding to the recessed portion 9 of the gate 5 is also recessed. However, the recessed regions may increase the number of process steps.

Therefore, an examination was conducted by simulation on the configuration illustrated in FIG. 1A where the side surface of the insulating member 3 is not recessed and the recessed portion 9 is provided to only the gate 5, and the configuration illustrated in FIG. 20 where a portion of the first insulating layer 3*a* at a certain height from the substrate plane is not removed.

Figure 21:
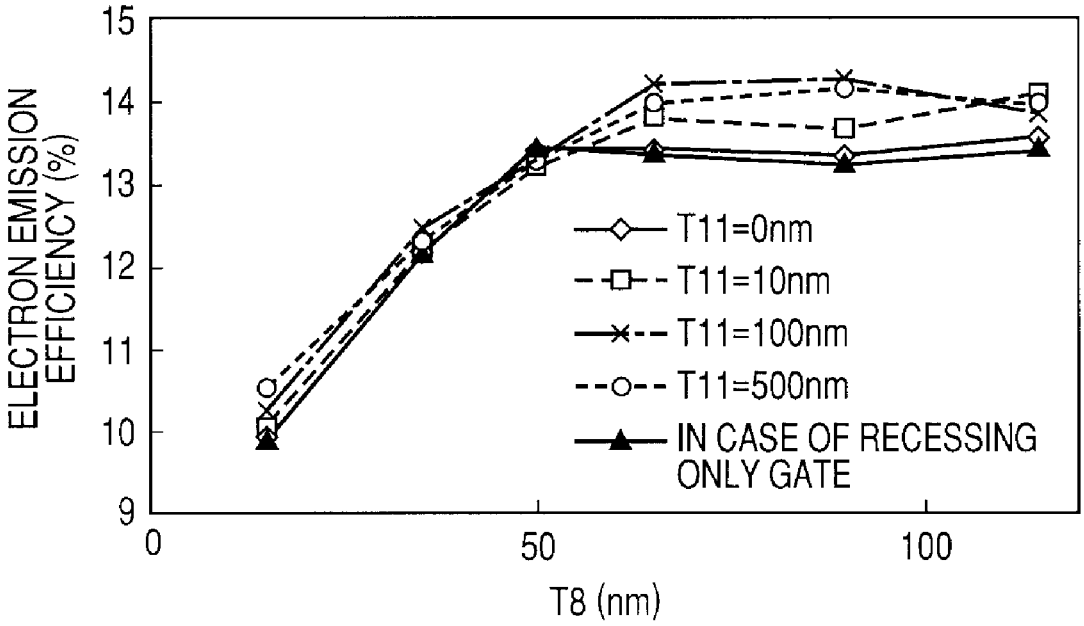
FIG. 21 is a graph showing the relationship for each height T11 of a recessed side surface of a first insulating layer between a recess distance T8 and electron emission efficiency, which is obtained by simulation.

The calculation results on the configuration of FIG. 20 when the recess distance T8 was 115 nm and a height T11 of a portion in which the side surface of the first insulating layer 3*a* in FIG. 20 was recessed so as to correspond to the recessed portion 9 was changed in a range of 0 nm to 500 nm are graphically shown in FIG. 21. In FIG. 21, the horizontal axis represents the recess distance T8 and the vertical axis represents the electron emission efficiency. In the drawing, the case of T11=0 refers to a case where the side surface of the second insulating layer 3*b* in FIG. 20 was recessed and the side surface of the first insulating layer 3*a* was not recessed. The case of T11=500 nm refers to a case where the side surfaces of the first insulating layer 3*a* were recessed entirely as illustrated in FIG. 2A. The cases of recessing only the gate and T11=0 refer to a case where the second insulating layer 3*b* was not recessed as well.

It can be seen from FIG. 21 that in the case of T11=0 where the side surface of the first insulating layer 3*a* was not recessed entirely, an increase in the electron emission efficiency can be expected by recessing the side surface of the second insulating layer 3*b*. Furthermore, it can be seen that an increase in the electron emission efficiency can be expected in the configuration where the second insulating layer 3*b* was not recessed as well but only the gate 5 was provided with the recessed portion. Furthermore, the recess distance Lsat at which the electron emission efficiency becomes constant was slightly smaller for the case of T11=0 than the case of recessing only the gate 5 and the case of T11>0. However, the value of Lsat did not changed much in the range of T11≧10 nm.

Comparison of Lsat Values Calculated by Expression and Simulation Results

From the foregoing calculation results, it can be seen that the parameters which affects the recess distance Lsat necessary for increasing sufficiently the electron emission efficiency are the work function Wf, the driving voltage Vf, and the height T2 of the notch 7 on condition that a relation T4≧T5 or (T5>T4 and T12<T13) is satisfied.

As described above, the expression expressing the recess distance Lsat using Wf, Vf, and T2 is given by the following expression (13).

$$Lsat=6\times T2\times\{1-(Wf/EVf)\} \quad (13)$$

Figure 22:
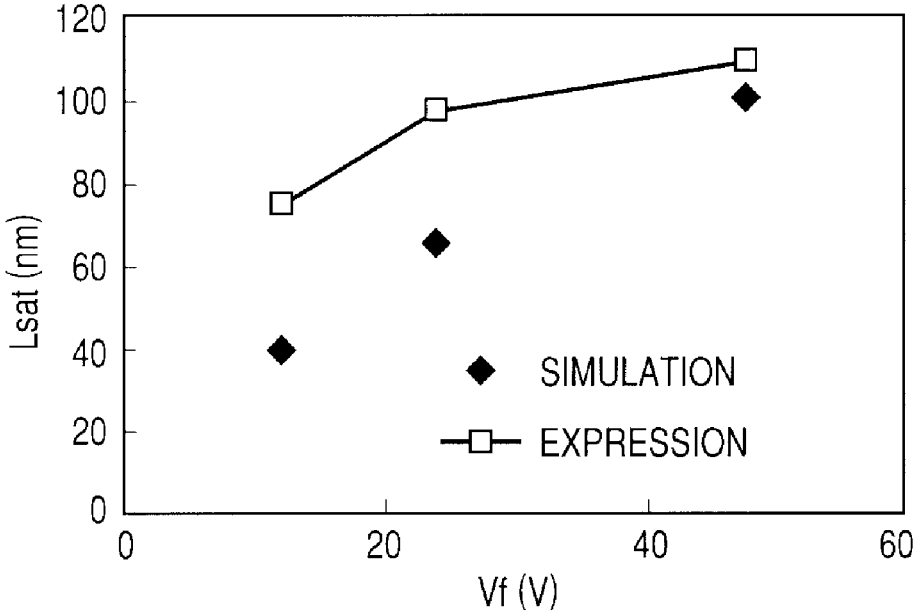
FIG. 22 is a graph showing the relationship between a saturation amount of the recess distance Lsat and a driving voltage Vf, in which calculation results obtained from simulation and values obtained from Expression are shown for comparison.
Figure 23:
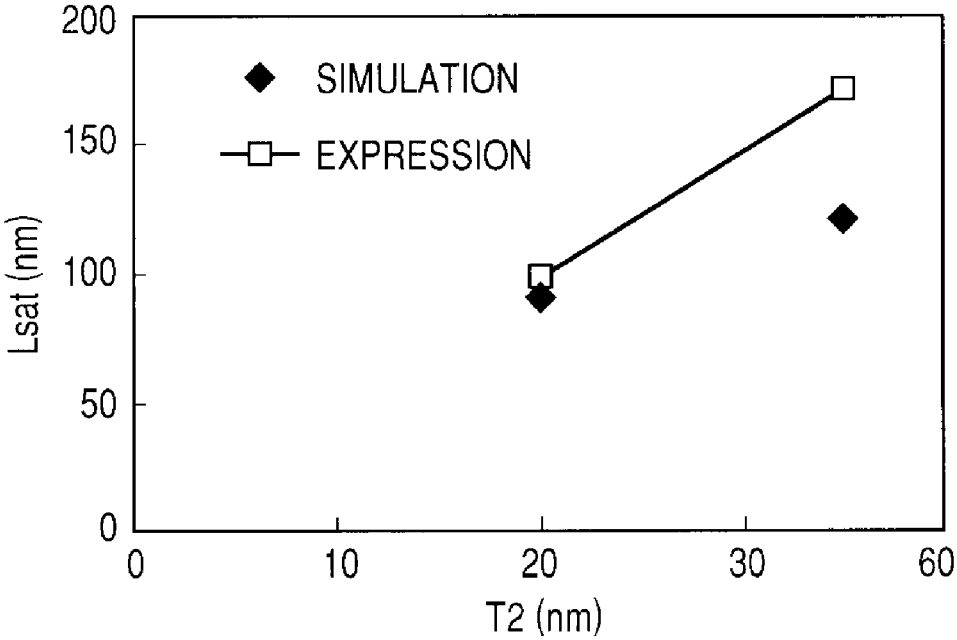
FIG. 23 is a graph showing the relationship between a saturation amount of the recess distance Lsat and a height T2 of the notch, in which calculation results obtained from simulation and values obtained from Expression are shown for comparison.
Figure 24:
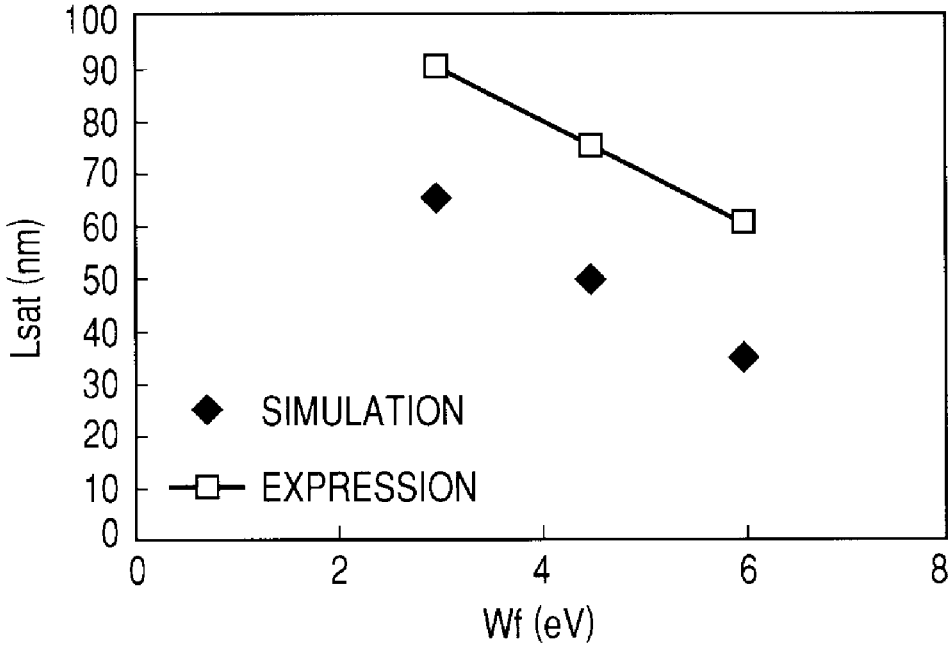
FIG. 24 is a graph showing the relationship between a saturation amount of the recess distance Lsat and a work function Wf, in which calculation results obtained from simulation and values obtained from Expression are shown for comparison.

The relationship between the recess distance Lsat obtained by the expression (13) and a recess distance $Lsat_{sim}$ calculated by simulation is graphically shown in FIGS. 22, 23, and 24.

In FIG. 22, the horizontal axis represents Vf, the vertical axis represents the recess distance Lsat, the work function Wf is set to 4.6 eV, and the height T2 of the notch 7 is set to 20 nm. For any value of Vf between 12 V and 48 V, Lsat is greater than $Lsat_{sim}$. Therefore, it can be seen that a sufficient effect of increasing the electron emission efficiency can be obtained by providing the recessed portion 9 by an amount calculated by the expression (13).

Similarly, in FIG. 23, the horizontal axis represents the height T2 of the notch 7, the vertical axis represents the recess distance Lsat, Vf is set to 24 V, and the work function Wf is set to 4.6 eV. For any value of T2 between 20 nm and 35 nm, Lsat is greater than $Lsat_{sim}$. Therefore, it can be seen that a sufficient effect of increasing the electron emission efficiency can be obtained by providing the recessed portion 9 by an amount calculated by the expression (13).

Furthermore, in FIG. 24, the horizontal axis represents the work function Wf, the vertical axis represents the recess distance Lsat, Vf is set to 12 V, and the height T2 of the notch 7 is set to 20 nm. For any value of Wf between 3 eV and 6 eV, Lsat is greater than $Lsat_{sim}$. Therefore, it can be seen that a sufficient effect of increasing the electron emission efficiency can be obtained by providing the recessed portion 9 by an amount calculated by the expression (13).

From the foregoing results, it was confirmed by simulation that the recess distance Lsat necessary for increasing sufficiently the electron emission efficiency can be expressed by the expression (13).

Example 3

An electron emitting device in which a projected portion 30 is provided on the gate 5 was produced as illustrated in FIGS. 25A to 25C. FIG. 25A is a plane view, FIG. 25B is a cross-sectional view taken along the line 25B-25B in FIG. 25A, and FIG. 25C is a right side view of FIG. 25A.

In this example, the cathodes 6 are provided in four sets, and the recess distance T8 was 100 nm.

A basic production method is the same as that of Example 1, and only the differences from Example 1 will be described.

In this example, molybdenum (Mo) used as the cathode material was also deposited to the upper surface of the gate 5, as illustrated in FIGS. 25A to 25C. The Ni delamination layer was formed on the gate 5 excluding a region in which the projected portion 30 will be formed. An EB evaporation method was used as a film formation method of Mo, and an inclination of the substrate was set to 80°. In this way, Mo was incident on the gate 5 at an incidence angle of 80° and on the RIE-processed sloped surface (side surface) of the insulating layer 3*a* of the device at an incidence angle of 20°. The evaporation was performed at a constant evaporation speed of about 10 nm/min while precisely controlling an evaporation period to be 2 minutes, whereby a Mo film was formed to a thickness of 20 nm on the sloped surface.

After the Mo film was formed, the Ni delamination layer 20 precipitated on the gate 5 was removed using an etching solution composed of iodine and potassium iodide, whereby unnecessary Mo film was delaminated from the gate 5.

After the delamination, a resist pattern was formed by a photolithography technique so that the width T4 of the cathode 6 was 3 μm and the distance T7 between the cathodes 6 was 3 μm. Thereafter, the cathodes 6 were processed using a dry etching method. Moreover, $CF_4$-based gas was used as a processing gas because when molybdenum is used as the cathode material, it forms fluorides.

The result of cross-sectional TEM (transmission electron microscopy)-based analysis on the device obtained thus was that the shortest distance T13 of the gap 8 between the cathode 6 and the gate 5 was 8.5 nm on average.

The electron emitting device was formed by the above-described method, and the same characteristic evaluation as Example 1 was conducted on the electron emitting device.

According to the evaluation result, the device exhibited characteristics that the electron emission current Ie was 6.2 μA on average at the driving voltage of 26 V, and the electron emission efficiency was around 15% on average.

Considering such characteristics, it can be supposed that the electron emission current was increased by an amount corresponding to the number of stripes by increasing the number of cathodes 6.

By the same production method, a device was produced while increasing the number of cathodes 6 by 100 times more than Example 3 and setting the width T4 of the cathode 6 and the distance T7 between the cathodes 6 to 0.5 μm. Moreover, the width T5 of the projected region of the gate 5 and the width of the recessed portion 9 were correspondingly set to 0.5 μm. With such a device, it was possible to obtain an electron emission amount which is larger by about 100 times than that of Example 3. In this example where a plurality of cathodes 6 is provided, since electrons can be emitted preferentially from the ends of the cathodes 6, it is possible to provide an electron beam source in which the electron beam shapes are more neatly arranged than the existing electron emitting devices. That is to say, it is possible to solve the difficulties in controlling the electron beam shape due to the fact that the electron emission locations are not fixedly determined as the case of the existing electron emitting devices, thereby providing an electron beam source in which the electron beam shapes are neatly arranged.

Example 4

In this example, an electron source substrate was formed by arranging a number of electron emitting devices, which were produced by the same manufacturing method as the electron emitting device produced in Example 1 of the present invention, on a substrate in a matrix form, and an image displaying apparatus illustrated in FIG. 26 was produced using the electron source substrate. As a rear plate 41, the electron source substrate 31 was used. Description of the manufacturing process of the image displaying apparatus of this example will be provided below.

Electrode Formation Process

Films of SiN, $SiO_2$, TaN, and Mo were sequentially formed on a glass substrate 31, the notch 7 was formed by the same manufacturing method as the electron emitting device of Example 1, and a step having the recessed portion 9 was processed by etching. In this example, the comb teeth-like shape was processed by a number of 100 per device so that 100 cathodes 6 were provided for one pixel.

Cathode Formation

Molybdenum (Mo) used as the cathode material was deposited to the upper surface of the gate 5. In this example, an EB evaporation method was used as a film formation method, and an inclination of the substrate 31 was set to 60°. In this way, Mo was incident on the gate 5 at an incidence angle of 60° and on the RIE-processed sloped surface of the insulating layer 3*a* (SiN) of the device at an incidence angle of 40°. The evaporation was performed at a constant evaporation speed of about 10 nm/min for a period of 4 minutes. The evaporation period was precisely controlled so that the Mo film was formed to a thickness of 40 nm on the sloped surface.

Thereafter, 100 stripes were processed by photolithography and etching, whereby an electron emitting device was formed.

Y-Direction Wire Formation Process

Next, the Y-directional wires 33 were arranged to be connected to the gate 5. The Y-directional wires 33 function as wires to which the modulation signals are applied.

Insulating Layer Formation Process

Subsequently, in order to isolate X-directional wires 32 produced in a later process from the Y-directional wires 33, an insulating layer formed of silicon oxides was arranged below the later-described X-directional wires 32 so as to cover the previously formed Y-directional wires 33. A contact hole was formed in a part of the insulating layer so that an electrical connection between the X-directional wires 32 and the electrode 2 can be achieved.

X-direction Wire Formation Process

Subsequently, the X-directional wires 32 mainly containing silver were formed on the previously formed insulating layer. The X-directional wires 32 intersect the Y-directional wires 33 as interposing the insulating layer and are connected to the electrode at the contact hole of the insulating layer. The X-directional wires 32 function as wires to which the scan signals are applied. In this way, a substrate having matrix wires was formed.

Subsequently, as illustrated in FIG. 26, a face plate 46 in which a fluorescent film 44 and a metal back 45 are laminated on the inner surface of a glass substrate 43 was arranged at a distance of 2 mm above the substrate 31 via a support frame 42.

Then, the bonding portions of the face plate 46, the support frame 42, and the substrate 31 were bonded by heating and cooling indium (In) which is a low-melting point metal. Moreover, in this bonding process, bonding and sealing were simultaneously carried out without using an exhaust pipe because this process was performed in a vacuum chamber.

In this example, the fluorescent film 44 used as a light-emitting member was formed using stripe-shaped phosphors in order to realize color display. First, black stripes (not illustrated) were formed, and phosphors (not illustrated) of each color were deposited in gap portions thereof by a slurry method, whereby the fluorescent film 44 was produced. A material was used mainly containing graphite which is typically used as the material for the black stripes.

Moreover, the metal back 45 formed of aluminum was provided on the inner surface side (electron emitting device side) of the fluorescent film 44. The metal back 45 was produced by depositing Al on the inner surface side of the fluorescent film 44 by vacuum evaporation.

An image displaying apparatus was produced by the processes described above, and the image displaying apparatus exhibited good display quality.

Example 5

An electron emitting device having the configuration illustrated in FIGS. 27A to 27D was produced by the processes illustrated in FIGS. 8A to 8G.

First, a PD 200 which is a low sodium glass developed for use in plasma displays was used as the substrate 1, and the insulating layers 23 and 24 were formed by a sputtering method using SiN ($Si_xN_y$) having a thickness of 500 nm and $SiO_2$ having a thickness of 30 nm, respectively. Subsequently, the conductive layer 25 was laminated by a sputtering method using TaN having a thickness of 30 nm (see FIG. 8A).

Subsequently, a resist pattern including the projected region 12 having a comb teeth-like shape and the recessed portion 9 was formed on the conductive layer 25 by a photolithography technique, and thereafter, the conductive layer 25, the insulating layer 24, and the insulating layer 23 were sequentially processed using a dry etching method (see FIG. 8B).

Moreover, $CF_4$-based gas was used as a processing gas because materials that form hydrofluoric acid were selected as the materials for the insulating layers 23 and 24 and the conductive layer 25. The result of RIE using this gas was that the etched side surfaces of the insulating layers 3*a* and 3*b* and the gate 5 were at an angle of about 80° relative to the horizontal plane of the substrate 1.

After the resist was delaminated, the side surface of the insulating layer 3*b* was etched by an etching method using BHF (which is a solution of ammonium fluoride and hydrofluoric acid) so that the depth T6 was about 70 nm, whereby the notch 7 was formed in the insulating member 3 (see FIG. 8C).

Then, Ni was electrolytically precipitated on the surface of the gate 5 by electroplating, and the delamination layer 20 was formed (see FIG. 8D).

Subsequently, a resist pattern for forming the recessed portion 9 was formed again on the gate 5 by a photolithography technique, and thereafter, the gate 5 and the insulating layers 3*a* and 3*b* were sequentially processed using a dry etching method to form the recessed portion 9, and a part of the insulating member 3 was removed.

At this time, the comb teeth-like shape was processed at a pitch of 6 μm so that the recess distance T8 of the recessed portion 9 was 5 μm, and the width T7 of the recessed portion 9 and the width T5 of the projected region 12 were each 3 μm. Moreover, the Y-directional length of the electron emitting device was 100 μm.

After the resist was delaminated, Ni was electrolytically precipitated on the surface of the gate 5 by electroplating, and the delamination layer 20 was formed (see FIG. 8D).

Subsequently, molybdenum (Mo) used as the cathode material 26 was deposited to the upper surface of the gate 5, the side surface of the insulating member 3, and the surface of the substrate 1. In this example, an EB evaporation method was used as the film formation method. In this formation method, an inclination of the substrate 1 was set to 60° relative to the horizontal plane. In this way, Mo was incident on the gate 5 at an incidence angle of 60° and on the RIE-processed sloped surface of the insulating member 3 at an incidence angle of 40°. The evaporation was performed at a constant evaporation speed of about 12 nm/min while precisely controlling an evaporation period to be 2.5 minutes, whereby a Mo film was formed to a thickness of 30 nm on the sloped surface (see FIG. 8E).

After the Mo film was formed, the Ni delamination layer 20 precipitated on the gate 5 was removed using an etching solution composed of iodine and potassium iodide, whereby the Mo film on the gate 5 was delaminated (see FIG. 8F). At this time, since the delamination layer 20 was not formed on the surface of the insulating member 3 exposed to the recessed portion 9, the cathode material 26 was not removed.

Thereafter, etching was performed again using BHF so as to cause the film of the cathode material 26 formed on the surface of the insulating member 3 exposed to the recessed portion 9 to be electrically isolated from the gate 5 and cause the cathode 6 to be electrically isolated from the gate 5. In this way, the cathode material 26 deposited on the side surfaces of the insulating layer 3*b* was lifted off, whereby an electrically isolated state was achieved.

The result of cross-sectional TEM-based analysis was that the shortest distance T13 of the gap 8 between the cathode 6 and the gate 5 was 9 nm.

Subsequently, Cu was deposited to a thickness of 500 nm by a sputtering method and patterned, whereby the electrode 2 was formed (see FIG. 8G).

The electron emitting device was formed by the above-described method, and the characteristics of the electron emitting device were evaluated using an arrangement illustrated in FIG. 9.

Here, the electron emission efficiency η is typically given by an expression, $\eta = Ie/(If+Ie)$, using the current If detected upon application of a voltage to the device and the current Ie extracted into a vacuum.

In this example, since the cathode 6 and the control electrode 13 are electrically connected to each other, the potential difference Vc between the gate 5 and the control electrode 13 is the same as the potential difference Vf between the cathode 6 and the gate 5.

The electron beam shape obtained with the device of this example was measured under the conditions Va=11.8 kV, Vf=Vc=24 V, h=1.66 mm, and the measurement result showed that the size of the electron beam in the Y-direction was 230 μm and the X-direction beam size was 130 μm.

Comparative Example

An electron emitting device was produced having a configuration similar to Example 5, except that neither the recessed portion 9 nor the control electrode 13 was provided to the gate 5, and the effect was evaluated.

The device of this example was produced by the same manufacturing process as Example 5, except that the recessed portion 9 was not etched out, the gate 5 was processed into a straight-line shape, and only the cathode 6 was formed like stripes.

The same characteristic evaluation as Example 5 was conducted on an electron source obtained thus. The electron beam shape was measured under the conditions Va=11.8 kV, Vf=Vc=24 V, h=1.66 mm, and the measurement result showed that the size of the electron beam in the Y-direction was 300 μm and the X-direction beam size was 120 μm.

Example 6

Various devices having the configuration illustrated in FIG. 27A were produced with different widths T5 of the projected region 12 of the gate 5 by the same manufacturing process as Example 5. The dependence on T5 was examined.

In this example, xs was about 1 μm under the conditions Va=11.8 kV, Vf=Vc=24 V, h=1.66 mm. It was observed that when T5 is decreased, the size of the electron beam in the Y-direction decreases as T5 becomes smaller than a certain value. This tendency is graphically shown in FIG. 31. In FIG. 31, the horizontal axis is T5/*xs*. It can be seen from FIG. 31 that the effect of converging the size of the electron beam in the Y-direction appears at T5/*xs*<5.

The size of the electron beam in the Y-direction was about 300 μm in case of T5=100 μm and the size of the electron beam in the Y-direction showed a gradual decrease as T5 was decreased to 9 μm, 5 μm, 3 μm, and so on.

Example 7

An electron emitting device having a configuration illustrated in FIG. 34A was produced. In this example, T5 and T5*x* were 5 μm.

A basic production method is the same as that of Example 5, and only the differences from Example 5 will be described.

In this example, wires (not illustrated) for supplying voltage to the gate 5 were provided under the insulating layer 3*a*, and a contact hole was formed so as to pass through the insulating layers 3*a* and 3*b* and the gate 5. Thereafter, a film of cathode formation material was formed, and the gate 5 and the wires were electrically connected in the cathode formation process. The contact hole had a dimension of 1 μm in X and Y directions.

The device was formed by the afore-mentioned method, and the same evaluation as Example 5 was conducted on a beam shape obtained with this device.

The electron beam shape obtained with the device of this example was measured under the conditions Va=11.8 kV, Vf=Vc=24 V, h=1.66 mm, and the measurement result showed that the size of the electron beam in the Y-direction was 230 μm and the X-direction beam size was 70 μm.

From the above result, in the configuration of this example, it was confirmed that the beam convergence effect by a circular electric field can be obtained in the X direction as well as the Y direction. Image displaying apparatuses were produced using the electron emitting devices of Examples 5 to 7 by the same method as Example 4, and the image displaying apparatuses exhibited display quality as good as in Example 4.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-029312, filed Feb. 12, 2009, and No. 2009-030586, filed Feb. 13, 2009 which are hereby incorporated by reference herein in their entirety.

What is claimed is:

1. An electron emitting device comprising:

an insulating member having a notch on its surface;

a gate positioned on the surface of the insulating member;

at least one cathode having a protruding portion protruding from an edge of the notch toward the gate, and positioned on the surface of the insulating member so that the protruding portion is opposed to the gate; and an anode arranged to be opposed to the protruding portion via the gate, wherein the gate is formed on the surface of the insulating member so that at least a part of a region opposed to the cathode is projected outward and recessed portions are provided in which ends of the gate are recessed and interpose the projected region, wherein either of following two conditional expressions is satisfied:

$$T4=T5, \text{ and} \quad \text{i)}$$

$$T4<T5 \text{ and } T12<T13, \quad \text{ii)}$$

where T4 [m] represents a width of the cathode, T5 [m] represents a width of the projected region of the gate, T12 [m] represents a length of a portion where the projected region of the gate protrudes from a region opposed to the cathode, and T13 [m] represents a shortest distance between an end of the cathode and the gate, and wherein, if it is assumed that a height of the notch in a laminating direction of the gate and the insulating member is T2 [m], a recess distance of the recessed portion is T8 [m], a work function of the cathode is Wf [eV], and energy when one electron is accelerated by voltage Vf [V] applied between the cathode and the gate is EVf [eV], then an expression $T8 \geqq 6 \times T2 \times \{1-(Wf/EVf)\}$ is satisfied.

2. The electron emitting device according to claim 1, wherein two or more of the cathodes are provided, and the gate is formed like teeth of a comb on the surface of the insulating member.

3. The electron emitting device according to claim 1, wherein at least a part of the insulating member corresponding to the recessed portion of the gate is formed so that the surface is recessed as is the recessed portion.

4. An image displaying apparatus comprising:

the electron emitting device as described in claim 1; and light-emitting members positioned outside the anode.

5. An electron emitting device comprising:

an insulating member having a notch on its surface;

a gate positioned on the surface of the insulating member;

at least one cathode having a protruding portion protruding from an edge of the notch toward the gate, and positioned on the surface of the insulating member so that the protruding portion is opposed to the gate; and an anode arranged to be opposed to the protruding portion via the gate, wherein the gate is formed on the surface of the insulating member so that at least a part of a region opposed to the cathode is projected outward and recessed portions are provided in which ends of the gate are recessed and interpose the projected region, wherein either of following two conditional expressions is satisfied:

$$T4=T5, \text{ and} \quad \text{i)}$$

$$T4<T5 \text{ and } T12<T13, \quad \text{ii)}$$

where T4 [m] represents a width of the cathode, T5 [m] represents a width of the projected region of the gate, T12 [m] represents a length of a portion where the projected region of the gate protrudes from a region opposed to the cathode, and T13 [m] represents a shortest distance between an end of the cathode and the gate, and wherein a control electrode is arranged on the surface of the insulating member opposed to the anode via the recessed portion, and if it is assumed that voltage applied between the cathode and the gate is Vf [V], the voltage applied between the control electrode and the cathode is Vc [V], the voltage applied between the anode and the cathode is Va [V], a distance between a surface of the insulating member opposed to a side where the gate is disposed and the anode is h [m], a width of the projected region of the gate is T5 [m], and a circular constant is $\pi$, then an expression $T5<5\times(Vc/Va)\times(h/\pi)$ and an expression $Vf \geqq Vc$ are satisfied.

* * * * *